US012715565B2

(12) United States Patent
Verfaillie et al.

(10) Patent No.: US 12,715,565 B2
(45) Date of Patent: Aug. 25, 2026

(54) HAULING SYSTEM INVOLVING A CAPTIVE SAIL AND A FLYING MOORING LINE

(71) Applicant: AIRSEAS, Nantes (FR)

(72) Inventors: Swann Verfaillie, Toulouse (FR); Nicolas Fantin, Launaguet (FR); Stephane Jan, Montgiscard (FR)

(73) Assignee: KAWASAKI KISEN KAISHA LTD, Tokyo (JP)

( * ) Notice: Subject to any disclaimer, the term of this patent is extended or adjusted under 35 U.S.C. 154(b) by 352 days.

(21) Appl. No.: 18/549,911

(22) PCT Filed: Mar. 18, 2022

(86) PCT No.: PCT/EP2022/057122
§ 371 (c)(1),
(2) Date: Sep. 9, 2023

(87) PCT Pub. No.: WO2022/195060
PCT Pub. Date: Sep. 22, 2022

(65) Prior Publication Data

US 2024/0166322 A1 May 23, 2024

(30) Foreign Application Priority Data

Mar. 19, 2021 (FR) ..... FR2102788

(51) Int. Cl.
*B63H 9/072* (2020.01)

(52) U.S. Cl.
CPC ..... *B63H 9/072* (2020.02)

(58) Field of Classification Search
CPC ..... B63H 9/072
See application file for complete search history.

(56) References Cited

U.S. PATENT DOCUMENTS 2,433,344 A * 12/1947 Crosby ..... B64B 1/40 343/705
3,521,836 A * 7/1970 Struble, Jr. ..... B64F 1/14 244/116
3,987,746 A * 10/1976 McCulloh ..... B64D 23/00 244/155 A (Continued)

FOREIGN PATENT DOCUMENTS

WO WO2009026939 3/2009
WO WO-2009026939 A1 * 3/2009 ..... B63H 9/069

(Continued)

*Primary Examiner* — Marc Q Jimenez
*Assistant Examiner* — Jovon E Hayes
(74) *Attorney, Agent, or Firm* — Defillo & Associates, Inc; Evelyn A. Defillo

(57) ABSTRACT

Captive wing traction system (1) including: a trajectory control flying device (7) attached to a traction wing (5) by fixed suspension lines (6) and mobile suspension lines (6), the trajectory control flying device (7) being adapted to control the mobile suspension lines (6); a traction line (8) connecting the trajectory control flying device (7) to the base platform (3); a guide line (9) that connects the leading edge (16) of the traction wing (5) to the trajectory control flying device (7); a stowage line (10) one end of which is connected to the base platform (3) and the other end of which is slidably connected to the guide line (9); a deflector element (13) attached to the stowage mast (4).

25 Claims, 20 Drawing Sheets

(56) References Cited

U.S. PATENT DOCUMENTS

| | | | | | |
|---|---|---|---|---|---|
| 4,102,291 | A * | 7/1978 | Sebald | B63J 3/00 | 114/244 |
| 4,497,272 | A * | 2/1985 | Veazey | B63H 9/069 | 244/32 |
| 5,271,351 | A * | 12/1993 | Horiuchi | B63H 9/10 | 114/106 |
| 5,355,817 | A * | 10/1994 | Schrems | B63H 9/06 | 114/39.28 |
| 5,642,683 | A * | 7/1997 | Bedford | B63H 9/071 | 114/39.21 |
| 6,918,346 | B2 * | 7/2005 | Grenier | B63H 9/069 | 114/102.16 |
| 7,866,271 | B2 * | 1/2011 | Wrage | B63H 9/069 | 114/102.16 |
| 8,117,977 | B2 * | 2/2012 | Reusch | B63H 9/069 | 114/102.16 |
| 2011/0041747 | A1 * | 2/2011 | Reusch | B63H 9/069 | 114/39.29 |

FOREIGN PATENT DOCUMENTS

| | | | | |
|---|---|---|---|---|
| WO | WO2017085501 | | 5/2017 | |
| WO | WO-2017085501 | A1 * | 5/2017 | F03D 13/20 |
| WO | WO2019239044 | | 12/2019 | |
| WO | WO-2019239044 | A1 * | 12/2019 | B63H 9/1021 |

* cited by examiner

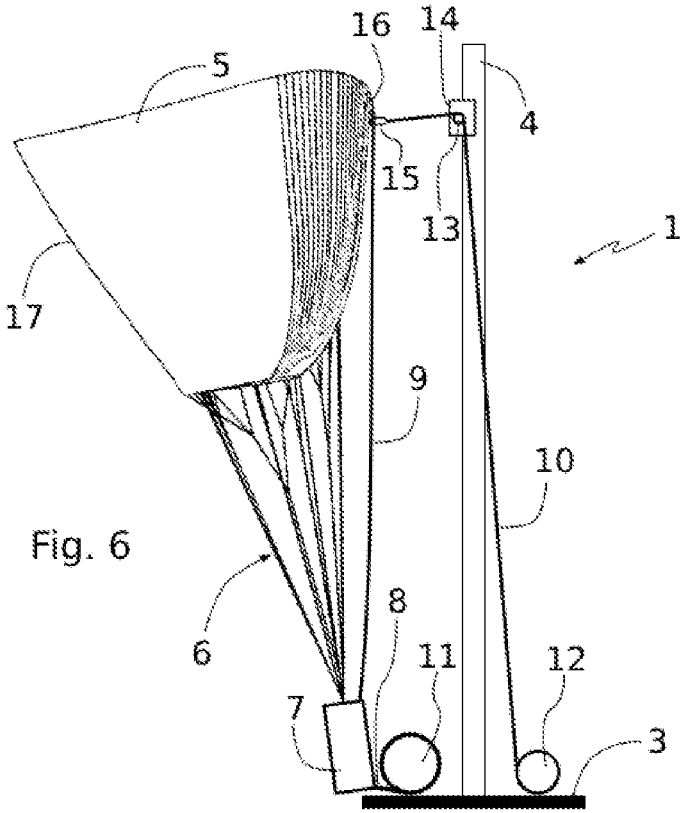
Fig. 6
Fig. 7
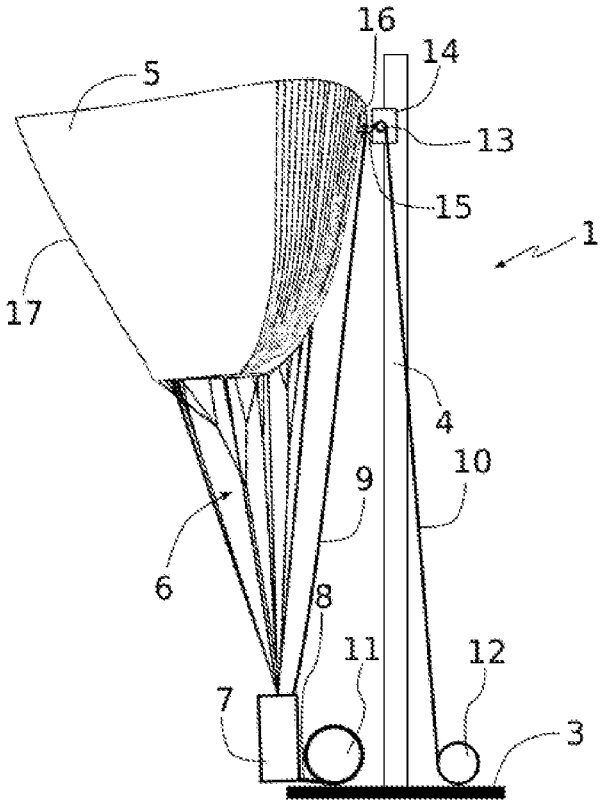

HAULING SYSTEM INVOLVING A CAPTIVE SAIL AND A FLYING MOORING LINE

CROSS REFERENCE TO RELATED APPLICATION

This application is a national stage entry of PCT/EP2022/057122 filed Mar. 18, 2022, under the International Convention and claiming priority over French Patent Application No. FR2102788 filed Mar. 19, 2021.

TECHNICAL FIELD

The invention concerns the field of captive wing traction systems that are adapted to deploy and to fold a traction wing relative to a base platform, that traction wing being adapted to generate a traction force because of the effect of the wind.

Such captive wing traction systems therefore enable the deployment of a floating traction wing serving for the propulsion of a vehicle, in particular a ship (as main propulsion or by way of assistance), for the production of electricity, or for any application benefiting from such traction force.

PRIOR ART

The patent application U.S. Pat. No. 7,866,271 describes a deployment system for a flying wing type device. That system includes a telescopic mast provided with an adaptor at the head of the mast that is adapted to pivot about the longitudinal axis of the mast. A life line is routed along the mast, projects from the adaptor, and is slidably attached to the traction cable that retains the flying wing, at a level of a deviation of the traction cable the end of which is connected to the leading edge of the wing.

The flying wing includes an inflatable leading edge and the life line in particular enables that inflatable leading edge to be brought up against inflation means provided in the mast head adaptor, the latter having a shape complementary to the profile of the leading edge of the wing.

To fold the flying wing the traction cable is wound in by a winch to bring the wing to the height of the mast. The life line, which until then was stowed close to the winch during the flight phase, is then pulled by a recovery point trolley. A guide slides along the traction cable from the recovery point trolley as far as the leading edge of the wing and pulls the wing against the mast. The wing is then furled.

SUMMARY OF THE INVENTION

The invention has for object improving prior art captive wing traction systems.

To this end the invention concerns a captive wing traction system including a traction wing adapted to generate a traction force because of the effect of the wind and adapted to be deployed and folded relative to a base platform that is provided with a stowage mast, the traction wing having a leading edge and a trailing edge, this captive wing traction system further including:

- a trajectory control flying device attached to the traction wing by fixed suspension lines and mobile suspension lines, the trajectory control flying device being adapted to control the mobile suspension lines;
- a traction line connecting the trajectory control flying device to the base platform.

This captive wing traction system further includes:

- a guide line that connects the leading edge of the traction wing to the trajectory control flying device;
- a stowage line one end of which is connected to the base platform and that is connected in a sliding manner to the guide line;
- a deflector element that is attached to the stowage mast and through which the stowage line is routed between its first end and its connection to the guide line.

The lines in question, whether suspension lines, traction lines, guide lines or stowage lines, may consist of any means enabling a flexible connection, for example ropes, textile and/or metal cables, etc.

Such a captive wing traction system enables deployment and folding of any type of traction wing, including traction wings having no inflatable leading edge, which are simpler and offer better performance. The system as a whole is therefore simplified in connection with modification of the deployment and folding procedure.

Such a captive wing traction system benefits from stowage means (formed in particular by the guide line and the stowage line) that enable the leading edge of the traction wing to be held against the stowage mast by the deflector element. These stowage means are rapid and simple to use, with no manipulation of lines. In fact, the system performs all the operations of deployment or folding of the traction wing without the stowage of the wing necessitating operations in which lines are captured and placed in attachment and traction means. Those operations, which are necessary in the prior art, are time consuming and difficult to automate. If they are automated they are subject to untimely failures (in particular in difficult environments such as propulsion of a ship under severe meteorological conditions). The invention guarantees entirely automatic deployment and folding procedures with no unforeseen turn of events, even under the most difficult conditions, thanks to stowage means that include only captive lines.

Direct retention of the leading edge of the wing against the stowage mast by traction from the deflector element necessitates no complex interface espousing the shape of the traction wing, which enables a design of the stowage mast that is simpler, lighter in weight and less costly.

The leading edge of the wing does not necessitate a complex interface with the stowage mast either, and the stowage means enable a constant connection to be maintained between the traction wing and the base platform without disturbing the flight of the traction wing.

In a similar manner to a suspension line, the guide line is routed between the trajectory control flying device and the leading edge of the traction wing. The guide line is attached on the one hand to the trajectory control flight device and on the other hand to the leading edge of the traction wing, possibly by way of an intermediate part. The guide line preferably has a length sufficient not to generate any traction between the leading edge of the wing and the trajectory control flying device, so as not to disturb the functioning of the suspension lines during flight. The guide line does not unduly disturb the flight of the wing, however, because its mass and the drag it generates are comparable to that of a suspension line and no disturbance resulting for example from twisting is to be expected.

For its part the stowage line is adapted to slide along the guide line to occupy at least two stable positions:

- a stowage position, which can be locked, in which the end of the stowage line is in a high position, in the vicinity of the leading edge of the wing so that traction on the stowage line drives traction on the leading edge of the wing;

a flight position in which the end of the stowage line is disposed against the trajectory control flying device and rests thereon.

The stowage position enables dynamic locking of the leading edge of the wing against the stowage mast while the flight position enables the stowage line to be maintained ready for use during the flight, without the stowage line generating any force on the leading edge of the traction wing, despite its maximum length of several hundred meters, with the associated drag and mass.

The trajectory control flying device is a mechanism sized to support both the forces in the traction line and the traction forces in the suspension lines. During flight virtually all of the flying mass of the stowage line is supported by the trajectory control device and does not influence the shape of the traction wing, neither the aptitude of the trajectory control flying device to control the wing nor the movements of the traction line.

The conjoint work of the stowage line and the guide line make it possible to render independent of one another, to a certain degree, the task of controlling on the one hand the length of the traction line and on the other hand the length of the stowage line. The stowage line can therefore be controlled to lock the leading edge of the wing or to the contrary to release it relative to the stowage mast at different heights on the stowage mast, independently of whether the traction line is or is not at a predetermined height, and it is not necessary to act on the length of the traction line to act on the stowage line. The operations of hoisting or hauling down the traction wing can therefore be carried out with benefit to the possibility of mooring the traction line to the traction mast at any height and dynamically maintaining that mooring during the movement of the traction wing along the traction mast.

The captive wing traction system in accordance with the invention may have the following additional features, separately or in combination:

the stowage line is slidably connected to the guide line by a slider;

the slider is fixed to the stowage line and pivotally and slidingly connected to the guide line;

the slider includes a shuttle sliding along the guide line, that shuttle including a guide means through which the stowage line passes;

the guide line consists of a double line and the shuttle is slidably mounted on that double line;

the trajectory control flying device includes a receptacle adapted to receive the slider;

the receptacle includes a stowage line immobilizer;

the traction line is attached to the base platform by means of a first winch adapted to adjust the length of the traction line and the stowage line is attached to the base platform by a second winch adapted to adjust the length of the stowage line;

the deflector element is mounted on a stowage trolley sliding along the stowage mast;

the system includes means for driving the movement of the stowage trolley along the stowage mast;

the system includes means for retaining the end of the stowage line on the guide line, those retaining means being adapted to occupy: a free position in which the end of the stowage line slides freely along the guide line and a retaining position in which the end of the stowage line is disposed in a loop formed by the guide line;

said retaining means include a blocking member that is adapted, in a retaining position, to form on the guide line a loop for retaining the stowage line;

the blocking member includes a through-channel in which the stowage line extends when the retaining means are in the free position and in which the doubled over guide line extends when the retaining means are in the locked position;

the guide line is connected to the leading edge of the traction wing by a disengageable clamping element attached to the leading edge of the traction wing, that disengageable clamping element being adapted to retain the guide line by clamping it;

the disengageable clamping element includes a sleeve through which the guide line extends and the guide line is extended by an additional line portion extending beyond the leading edge of the traction wing;

the additional line portion is connected to the trailing edge of the traction wing;

the blocking member includes a housing adapted to receive the disengageable clamping element;

said housing includes a latch for retaining the disengageable clamping element;

the system includes: a plurality of folding lines each having an end fixed to the leading edge of the traction wing, being spaced from one another along that leading edge, an additional trolley adapted to slide along the stowage mast, a capture device that is attached to the leading edge of the traction wing and includes an attachment arm provided with an attachment rod, one of the folding lines projecting in line with the attachment rod and the stowage line having an end connected to the capture device;

the capture device includes a housing for the shuttle, the shuttle being mobile between a sliding configuration in which it slides along the guide line and a stowage configuration in which the shuttle is disposed in its housing;

the capture device includes a lever controlling pivoting of the attachment arm toward its attachment position, that lever being adapted to be actuated by the shuttle when it returns to its stowage configuration;

the system includes a stowage trolley adapted to slide along the stowage mast, that stowage trolley including a nesting interface for the capture device;

the stowage trolley includes means for immobilizing the capture device against the nesting interface;

the shuttle has a convex shape that is adapted to be housed in a concave shape of the nesting interface when the shuttle is in the stowage configuration;

the shuttle has an oblong shape.

In accordance with another object the invention concerns a method of controlling a captive wing traction system as described above. That method may have the following features, separately or in combination:

the method includes a phase of deploying the traction wing and a phase of folding the traction wing in which the second winch is controlled conjointly with the first winch so that the end of the stowage line slides along the guide line while the trajectory control flying element is moved farther away from or closer to the base platform;

the phase of folding the traction wing includes: a step of locking the stowage line onto the guide line; a stowage step in which traction on the stowage line drives traction on the guide line and on the leading edge of the traction wing;

the folding phase includes: a step of disengaging the disengageable clamping element, the guide line therefore being released; a step in which traction on the stowage line drives traction on the guide line and on the additional line portion;

the deployment phase and the folding phase include steps of hoisting or hauling down the traction wing along the stowage mast, during which steps the stowage trolley slides along the stowage mast and the stowage line remains under tension to hold the leading edge of the traction wing moored against the stowage mast;

the method includes a flight phase during which the slider is disposed on the receptacle of the trajectory control flying device and the length of the stowage line is controlled so as to maintain slack in the stowage line.

BRIEF DESCRIPTION OF THE FIGURES

Other features and advantages of the invention will emerge from the following non-limiting description with reference to the appended drawings, in which:

FIG. 6 depicts a subsequent step in the folding of the captive wing traction system;

FIG. 7 depicts a subsequent step in the folding of the captive wing traction system;

DETAILED DESCRIPTION OF THE INVENTION

Figure 1:
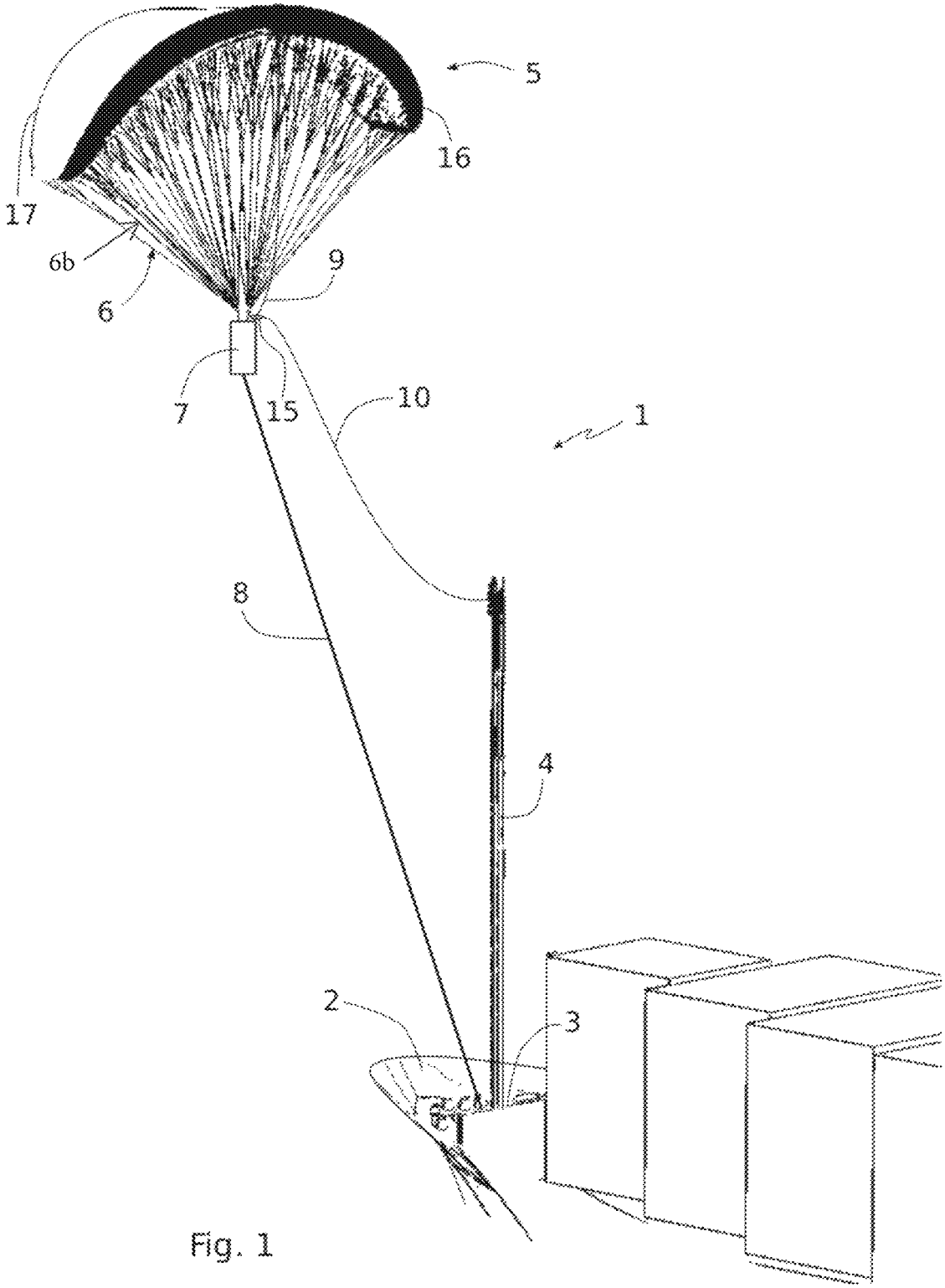
FIG. 1 is a perspective view of a captive wing traction system according to the invention in the flight phase.

FIG. 1 depicts a captive wing traction system 1 mounted on a ship 2 that in this example is a seagoing cargo ship (only the front of the ship has been represented in FIG. 1).

In the present example the captive wing traction system 1 is mounted on the prow of the ship 2 and is actuated as a complementary propulsion means of the ship enabling a saving of fuel. In this context the captive wing traction system 1 is sized according to the tonnage of the ship to be towed and is designed to be deployed and folded automatically.

Alternatively, this captive wing traction system 1 can be used for any other application requiring a captive wing traction system of this kind that can be deployed and folded automatically, for example as the principal propulsion means of a ship, for the propulsion of any other vehicle, for the production of electricity, etc.

The captive wing traction system 1 includes a base platform 3 that here is fixed to the deck of the ship 2 and on which is mounted a stowage mast 4 designed for the automatic deployment and folding operations of the system.

The captive wing traction system 1 further includes a traction wing 5 that is adapted to generate a traction force because of the effect of the wind. In the present example the traction wing 5 is a paraglider type sail. Any other flying equipment adapted to generate a traction force because of the effect of the wind may be employed instead, such as kites, hang gliders, kite type sails, etc. The traction wing 5 includes in the classic manner a leading edge 16 intended to be exposed to the incident wind and an opposite edge 17 termed the trailing edge.

The traction wing 5 is connected by a set of suspension lines 6 to a trajectory control flying device 7 that is adapted to act on the suspension lines 6 to control the flight of the traction wing 5.

The captive wing traction system 1 further includes a traction line 8 connecting the trajectory control flying device 7 to the base platform 3. The traction force generated by the wing 5 is transmitted by the traction line 8 to the ship 2 for the propulsion thereof and the traction line is sized accordingly. In the context of traction of a seagoing cargo ship the traction line may for example be a textile cable the diameter of which may be as much as several centimetres.

The trajectory control flying device 7 enables the flight of the traction wing 5 to be controlled in order to orient and to position the traction wing and possibly to cause the traction wing 5 to trace out flight paths enabling the traction force on the ship to be increased. Here the trajectory of the traction wing 5 is controlled by controlling the length of certain mobile suspension lines **6*b*, in the classic manner in the flying wing field. The set of suspension lines 6 in fact includes fixed suspension lines (that is to say lines that have a fixed length between their attachment to the traction wing 5 and their attachment to the trajectory control flying device 7) and mobile suspension lines 6*b* the length of which can be varied. The trajectory control flying device 7 is therefore adapted to pull on certain mobile suspension lines 6***b* and/or to release other mobile suspension lines 6*b* so that the aerodynamic profile of the traction wing 5 is modified with a view to controlling its lift, its trajectory, etc. The modification of the profile of a traction wing to control its trajectory is carried out in a classic manner and will not be described in more detail here.

The captive wing traction system 1 further includes a guide line 9 that connects the leading edge 16 of the traction wing 5 to the trajectory control flying device 7 and a stowage line 10 one end of which is connected to the base platform 3 and the other end of which is connected in a sliding manner to the guide line 9. These two lines 9, 10 are employed during phases of deployment and of folding of the traction wing 5.

The guide line 9 has a lower end that is fixed to the trajectory control flying device 7 and an upper end that is fixed to the leading edge 16 of the traction wing 5. The fixing between the guide line 9 and the leading edge 16 of the traction wing 5 may be effected by any appropriate means such as stitching the guide line 9 to the leading edge 16 of the traction wing 5. Alternatively, other fixing means, in particular adaptable fixing means, may be provided for fixing the guide line 9 to the leading edge 16 of the wing 5 (as in the second embodiment described later).

Figure 2:
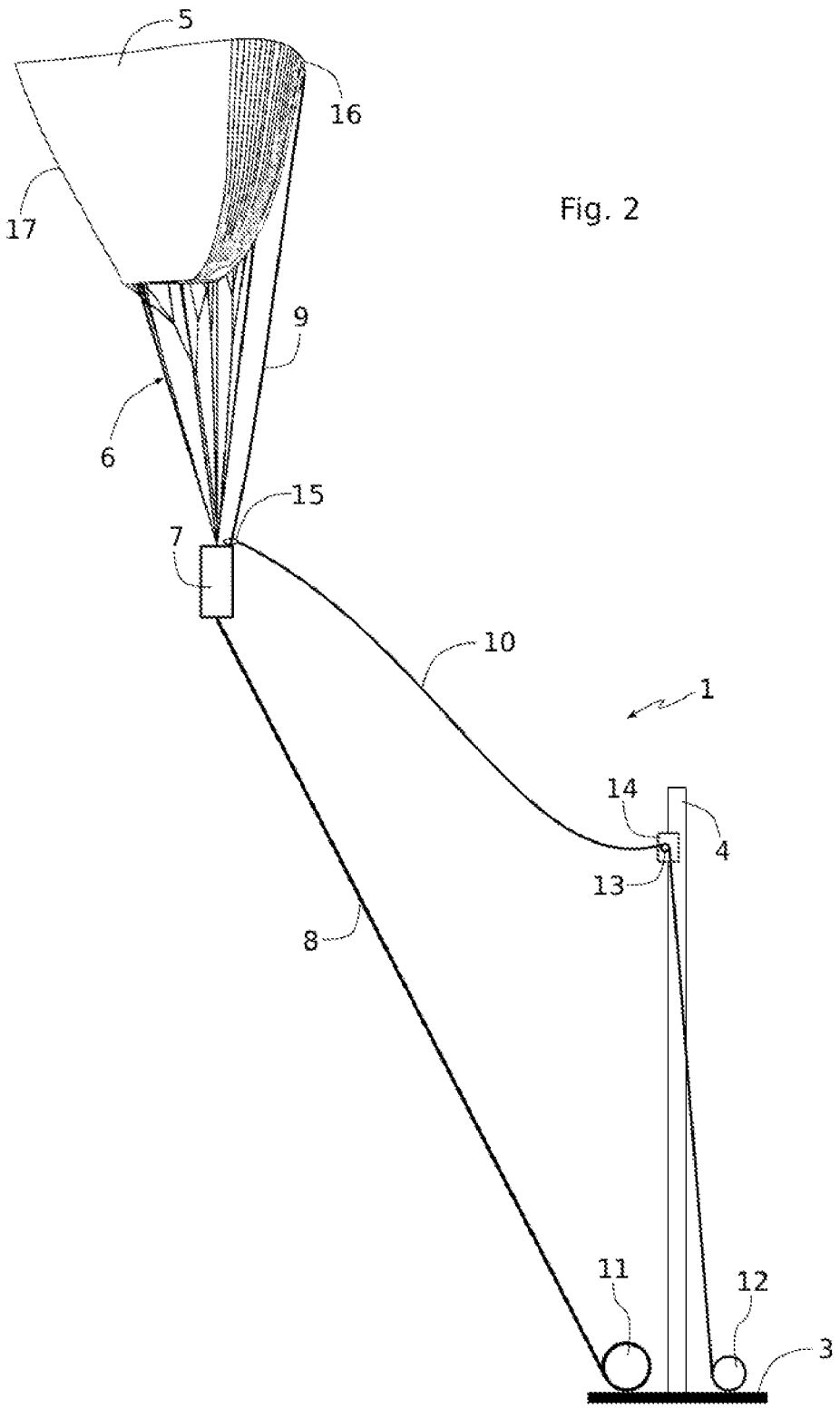
FIG. 2 is a schematic profile view of the captive wing traction system from FIG. 1.

FIG. 2 is a profile view of the captive wing traction system 1 in a phase of applying traction to the ship, as in FIG. 1. FIG. 2 depicts in a more schematic manner the various components of the captive wing traction system 1.

The traction line 8 is connected to the base platform 3 by a winch 11 controlled by a motor, for example an electric or hydraulic motor, adapted to unwind the traction line 8 to enable the traction wing 5 to gain altitude, or to the contrary to wind in that traction line 8 to move the traction wing 5 toward the base platform 3.

The stowage line 10 is also connected to the base platform 3 by a winch 12 independent of the winch 11 of the traction line 8. The winches 12, 11 are controlled in a coordinated manner, however. This stowage line 10 is moreover routed by a deflector element 13 mounted on the stowage mast 4. In the present example the deflector element 13 is for example a pulley mounted on a stowage trolley 14 or a low-friction ring. The stowage trolley 14 slides vertically along the moor mast 4 and includes means for driving that movement.

The end of the stowage line 10 is connected to the guide line 9 by a slider 15 that in the present example consists of an anti-friction ring fixed to the end of the stowage line 10 and connected in a pivoting and sliding manner to the guide line 9.

FIGS. 1 and 2 depict the captive wing traction system 1 in a traction configuration, the traction wing 5 being deployed and in flight and the system participating in the propulsion of the ship. In this configuration the slider 15 rests on the trajectory control flying device 7, because of the effect of its own weight and the weight of the stowage line 10. To this end, the winch of the stowage line 10 is controlled in such a manner as to leave sufficient slack in the stowage line 10 to enable the slider 15 to be placed on the trajectory control flying device 7.

The length of the guide line 9 may equally have some slack in all the flight configurations of the traction wing 5 so as to prevent the guide line 9, in flight, exerting traction on the leading edge 16 of the traction wing 5, so as not to disturb the flight of the traction wing 5. Alternatively, the guide line 9 may equally have the suspension function and thus participate in absorbing the force of the curvature created by the traction line, whilst guaranteeing that the forces caused by the weight of and the drag on the stowage line 10 are not transmitted to the leading edge 16 of the traction wing 5.

The trajectory control flying device 7 has on its upper face (that is to say its face that faces toward the traction wing 5) a receptacle adapted to receive and to retain the slider 15 during flight phases. The receptacle may consist of a base of the device 7 the shape of which is adapted to hold the slider 15 in place, for example a plane rest surface, an imprint in which the slider 15 may be accommodated, or a finger projecting from the device 7 that the ring here constituting the slider 15 comes to surround. This receptacle for the slider 15 may optionally include means for locking the slider 15 in the receptacle during flight phases.

When the winch 11 is controlled so as to release the traction line 8 so that the traction wing 5 is moved away from the base platform 3 the winch 12 is therefore also controlled to release the stowage line 10 so that this stowage line 10 retains its relaxed character and does not interfere with the flight of the traction wing 5. Accordingly, in flight configurations neither the guide line 9 nor the stowage line 10 acts on the shape or the trajectory of the traction wing 5.

The guide line 9 and the stowage line 10 are however involved in the phases of deployment and of folding of the traction wing 5. FIGS. 3 to 8 depict the successive steps enabling the traction wing 5 to be folded.

Figure 3:
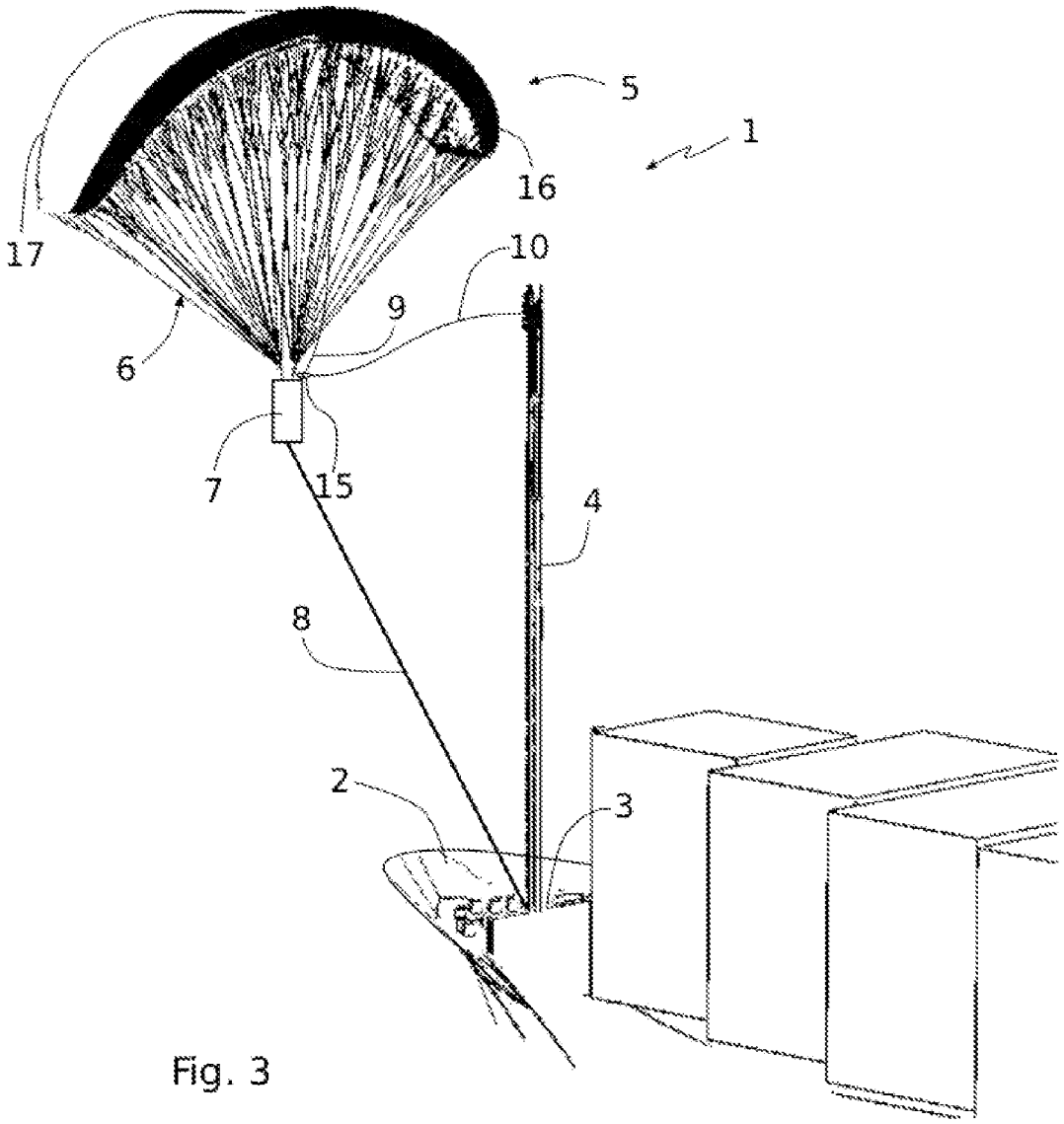
FIG. 3 is a view similar to FIG. 1, the traction wing of the captive wing traction system being in the process of being folded.
Figure 4:
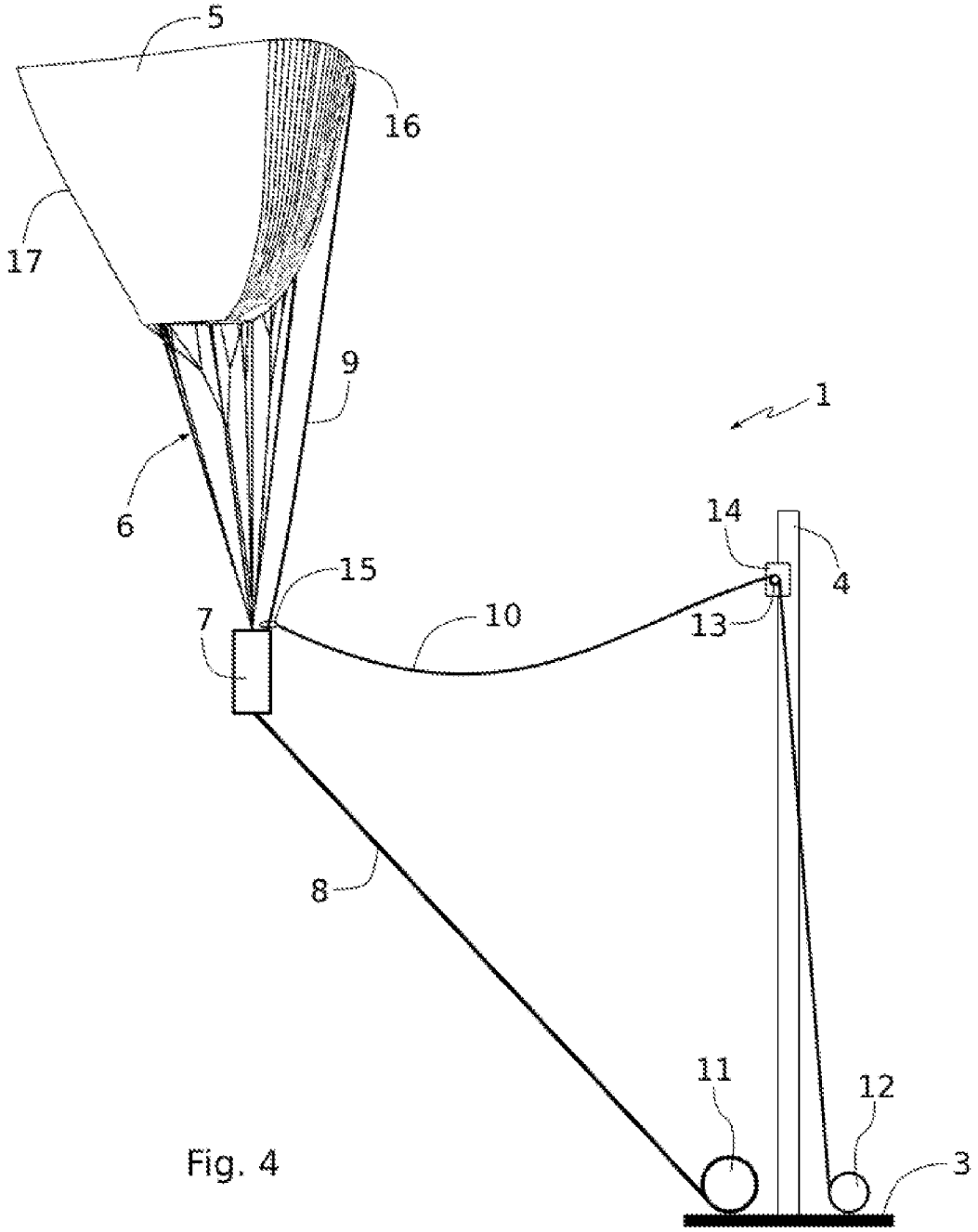
FIG. 4 is a schematic profile view of the captive wing traction system in its FIG. 3 position.

FIG. 3 is a view similar to FIG. 1, the system being in a first approach phase initiating the folding of the traction wing 5. During this approach phase the winch 11 winds in the traction line 8 so that the traction wing 5 is moved closer to the base platform 3. The winch 12 is simultaneously actuated to wind in the stowage line 10. The traction wing 5 then reaches an altitude at which the trajectory control flying device 7 is at an altitude close to that of the stowage trolley 14 (position depicted in FIGS. 3 and 4).

Figure 5:
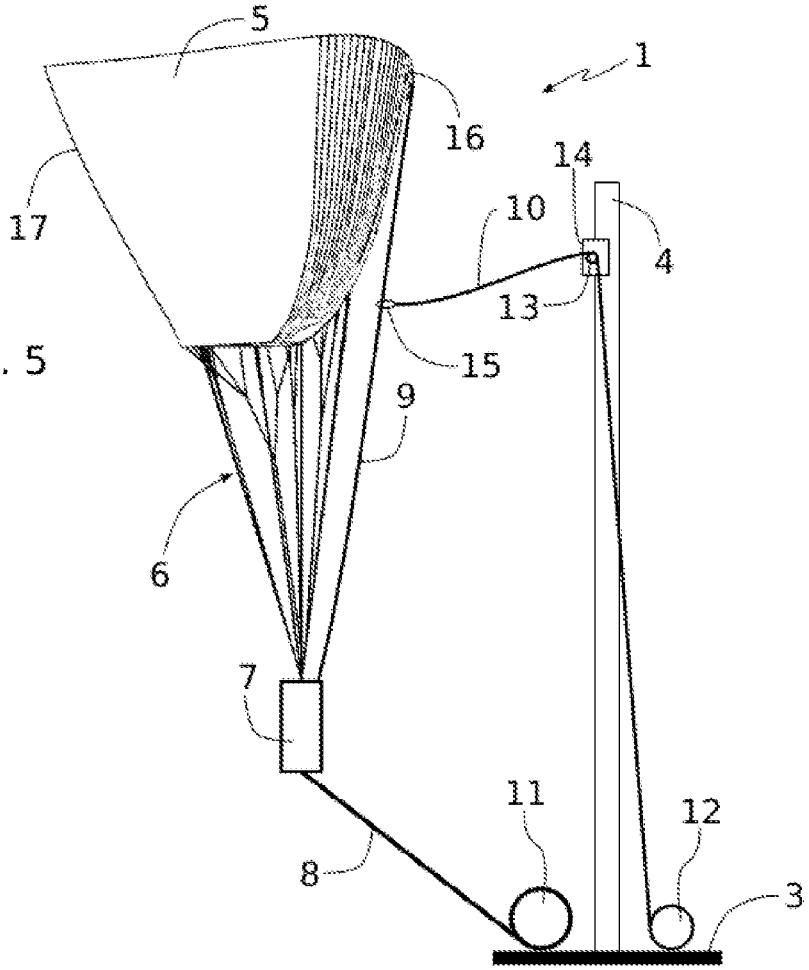
FIG. 5 depicts a subsequent step in the folding of the captive wing traction system.

From this position the action of the winches 11, 12 continues and drives the lowering of the trajectory control flying device 7 to an altitude less than that of the deflector element 13, as represented in FIG. 5. The slider 15 then rises along the guide line 9, thanks to the free sliding enabled by the pivoting sliding connection. The end of the stowage line 10 then rises along the guide line 9 as the traction wing 5 and the base platform 3 move closer together, as far as the FIG. 6 position in which the trajectory control flying device 7 has reached an abutment, for example a support element fastened to the base platform 3. The FIG. 5 schematic view merely depicts the trajectory control flying device 7 disposed against the base platform 3 (itself depicted by a simple base) on the understanding that, in practise, the base platform may be provided with any suitable receptacle for supporting and retaining the trajectory control flying device 7 when it is moved to its FIG. 5 position.

The height of the stowage mast 4 and the disposition of the deflector element 13 are chosen so that in the FIG. 6 position the slider 15 has reached the upper end of the guide line 9 and comes up against an abutment at the level of the leading edge 16 of the traction wing 5.

A stowage operation starting from the FIG. 6 position consists in actuating the winch 12 alone to pull in the stowage line 10, which drives movement of the leading edge 16 of the traction wing 5 closer, as far as a stowage position against the stowage trolley 14 depicted in FIG. 7.

The traction wing 5 is therefore retained by its leading edge 16, which is moored to the stowage mast 4. During all the operations described above the stowage mast 4 and/or the stowage trolley 14 are pivoted about the longitudinal axis of the stowage mast 4 so that the traction wing 5 is moored to the mast facing into the wind.

From the FIG. 7 position, in which the traction wing 5 is moored facing into the wind, the folding and stowage operations may then take place.

Figure 8:
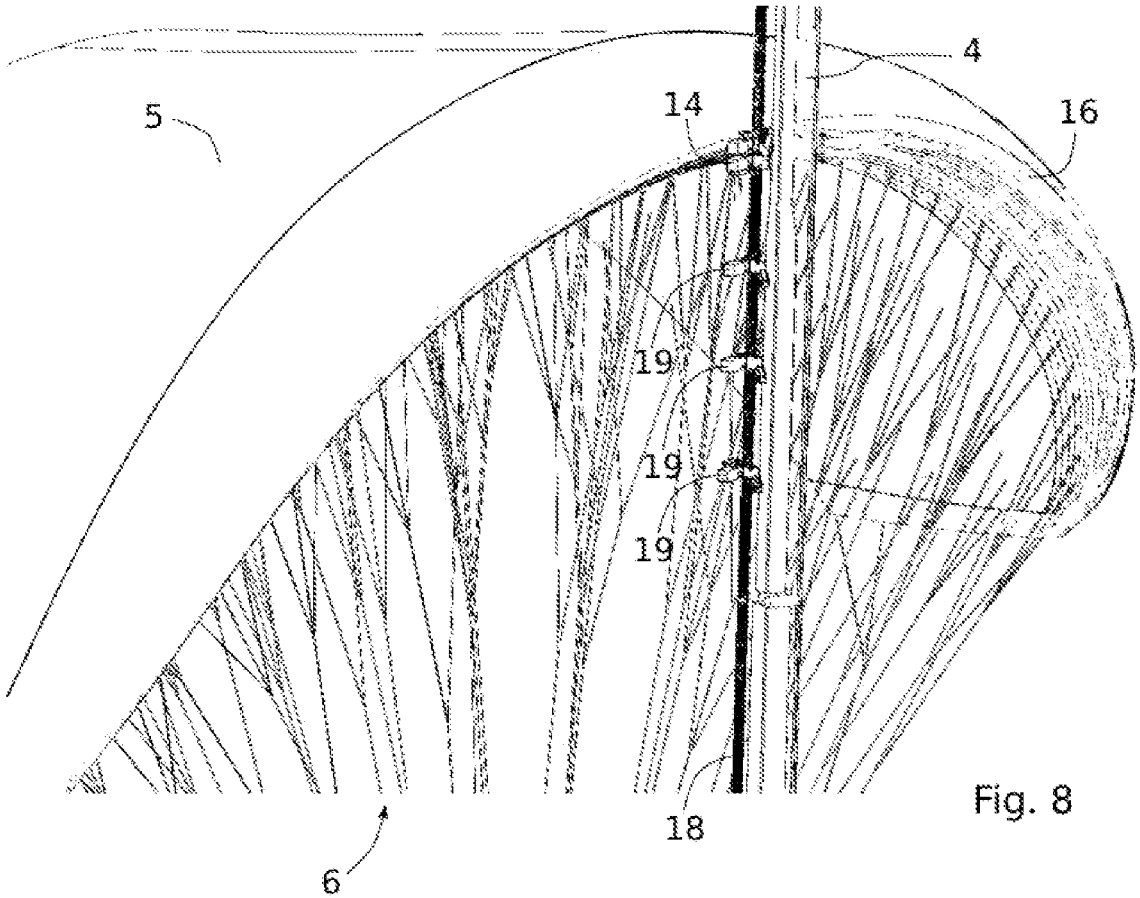
FIG. 8 is a perspective view of the traction wing in its FIG. 7 position.

FIG. 8 is a detail view depicting in perspective this stowage position that is maintained throughout all the operations of furling or folding the traction wing 5. FIG. 8 moreover depicts production detail variants given by way of example. Here the stowage mast 4 includes a rail 18 on which is slidably mounted the stowage trolley 14 carrying the deflector element 13. Other trolleys 19 are also provided on this rail 18, in particular trolleys enabling efficient folding of the traction wing 5 by grasping it by means of folding lines connected along the traction wing 5 (not represented). These additional trolleys 19 are for example trolleys enabling folding of the wing in two along the stowage mast 4, as described in the patent application WO2019239044. All the folding operations involving the additional trolleys 19 are carried out while the leading edge 16 of the traction wing 5 is held against the stowage mast 4 by the stowage line 10 and the guide line 9.

The captive wing traction system 1 preferably includes means for retaining the end of the stowage line 10 on the guide line 9. These retaining means are adapted to occupy: a free position in which the end of the stowage line 10 slides freely along the guide line 9 and a retaining position in which the end of the stowage line 10 is disposed in a loop formed by the guide line 9. Here these retaining means are adapted to retain the stowage line 10 on the guide line 9 when the slider 15 has come into abutment at the upper end of the guide line 9, that is to say in the position depicted in FIG. 6. The stowage operation that enables movement from the FIG. 6 position to the FIG. 7 position can then be carried out without risk of the stowage line 10 sliding on the guide line 9.

Figure 9:
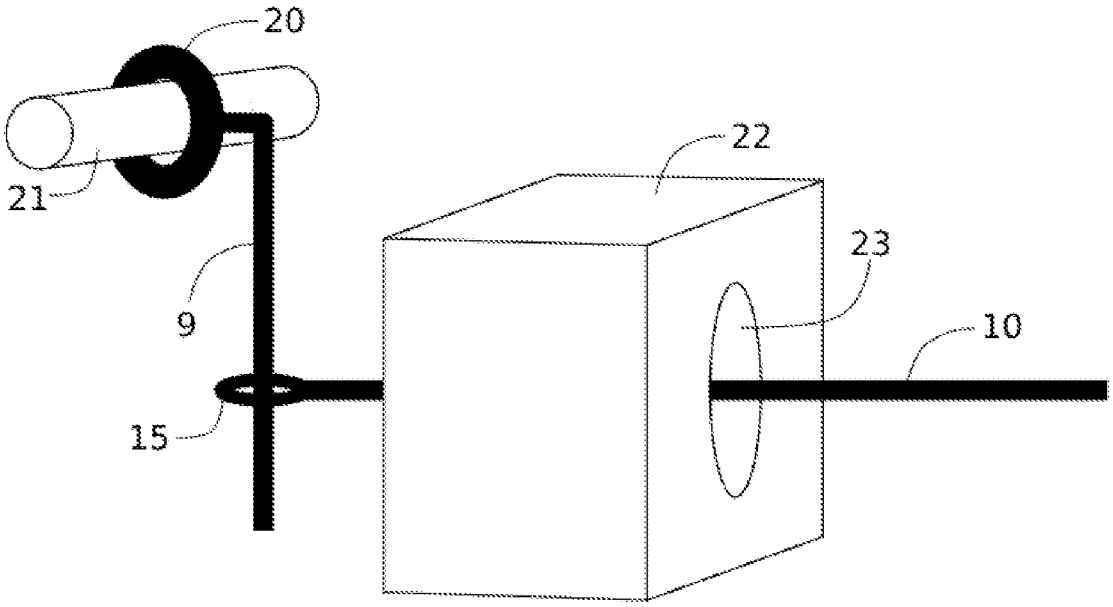
FIG. 9 is a schematic detail view of the flying line and of the guide line of the captive wing traction device from FIGS. 1 to 8.
Figure 10:
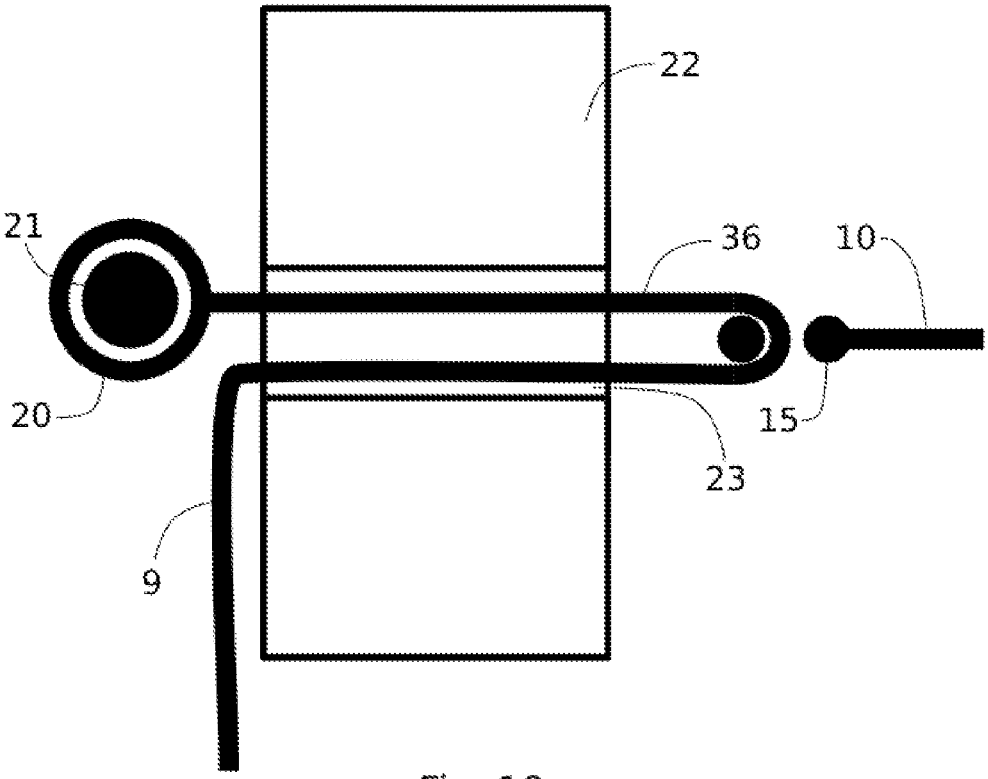
FIG. 10 depicts the functioning of the elements represented in FIG. 9.

FIGS. 9 and 10 depict one embodiment of these means for retaining the end of the stowage line 10 on the guide line 9. FIG. 9 is a schematic perspective view depicting the end of the stowage line 10, provided with the slider 15, cooperating with the end of the guide line 9 that is situated on the same side as the traction wing 5. In this example the guide line 9 is fixed by a ring 20 onto a bar 21. For its part the bar 21 is fastened to the leading edge 16 of the traction wing 5 (being for example inserted into a housing stitched to the leading edge 16). The stowage line 14 includes a locking member 22 through which passes a passage 23 having a diameter adapted to allow the slider 15 to pass through it.

During the stowage phase the traction applied to the stowage line 10 finishes by driving movement of the slider 15 through the through-passage 23. The slider 15 entrains with it the guide line 9 that also comes to pass through the through-passage 23 doubled over. The locking member therefore enables a loop 36 to be formed to retain the slider 15 and therefore the stowage line 10.

FIG. 10 is a schematic view in section of the elements from FIG. 9 after activation of the retaining means during the stowage operation. The slider 15 has therefore passed through the passage 23 and the stowage line 10 has passed into the passage 23 doubled over, through the locking member 22, forming the retention loop 36. Here the slack in the guide line 9 is sized to enable this passage of the guide line 9 doubled over to the FIG. 10 configuration in which continued traction on the stowage line 10 directly drives traction on the bar 21, and the stowage line 10 is therefore locked onto the guide line 9.

Once the traction wing 5 has been folded and furled, it may be stored until the next use.

The traction wing 5 is then deployed by operations carried out in the reverse order compared to the operations described above, with the traction wing 5 kept facing into the wind.

During deployment of the traction wing 5 it is retained by its leading edge 16 against the stowage mast 4, in order to unfold it and to prepare it for flight. The traction wing 5 is then in a position corresponding to FIGS. 7 and 8 and the means for retaining the stowage line 10 on the guide line 9 are activated.

Once these operations have been completed the traction wing 5 is released by an operation causing it to go from the FIG. 7 position to the FIG. 6 position, brought about by its winch 12 releasing the stowage line 10.

In the situation where retaining means corresponding to FIGS. 9 and 10 are provided, releasing the stowage line 10 drives unlocking by the movement of the slider 15, which passes again through the locking member 22 in the direction of the guide line 9. The leading edge 16 is then moved away from the stowage trolley 14.

From the FIG. 6 position the traction wing 5 is then flown by actuating the winches 11, 12 to release the traction line 8 and the stowage line 10. The traction wing then goes through a position corresponding to FIG. 5, the slider 15 descending along the stowage line 10 as the traction wing 5 rises.

The traction wing 5 then reaches its FIGS. 1 and 2 flight position, the slider 15 coming to take its place on its receptacle on the trajectory control flying device 7.

FIGS. 11 to 15 depict a second embodiment in which the captive wing traction system 1 includes alternative means for fixing the guide line 9 to the leading edge 16 of the traction wing 5 as well as complementary means for retention of the stowage line 10 on the guide line 9. Similar elements of the first and second embodiments bear the same reference numbers relating to the figures.

In accordance with this second embodiment the guide line 9 has an additional function of controlling an additional line portion 24 enabling action on the geometry of the traction wing 5. In the present example the additional line portion 24 extends the guide line 9 beyond the leading edge 16 of the traction wing 5, entering the internal space of the traction wing 5 or passing under or over the traction wing 5.

This additional line portion 24 may for example be a reefing line enabling reduction of the lift of the traction wing 5, a furling line enabling furling of the traction wing 5, or a line for moving the trailing edges 17 closer together, enabling closing of the trailing edge 17 by moving its edges closer together during the deployment or folding phase.

Figure 11:
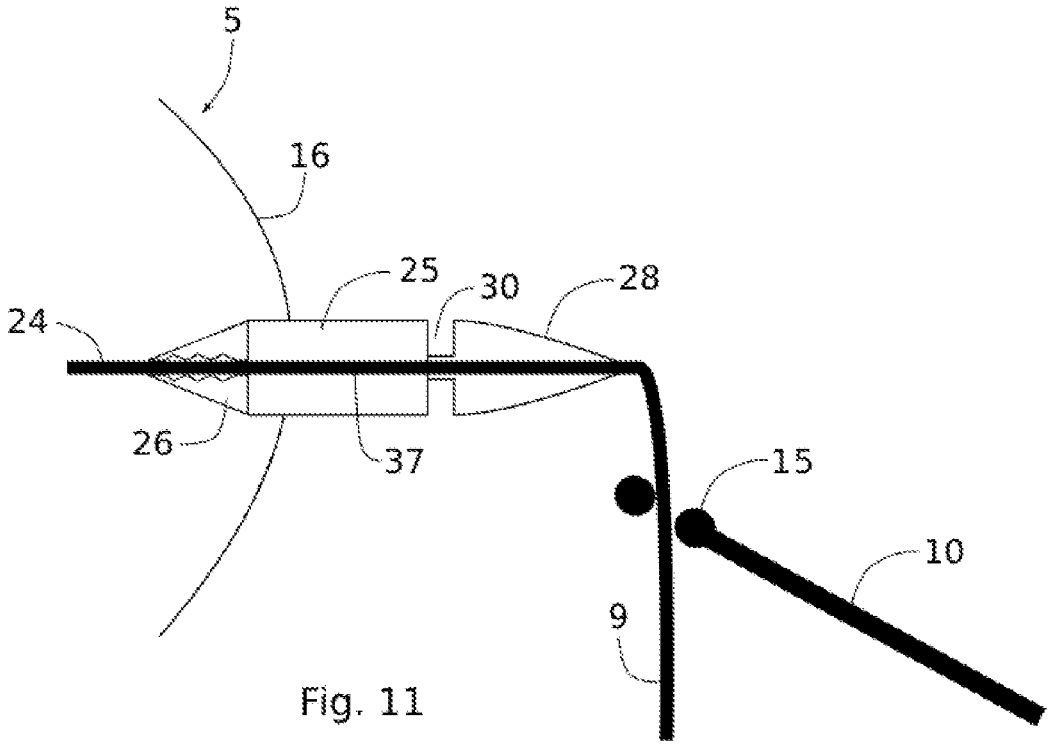
FIG. 11 is a view similar to FIG. 9 for a second embodiment of the captive wing traction system.

FIG. 11 depicts schematically a construction conforming to this second embodiment concerning the interface between the leading edge 16, the guide line 9, the stowage line 10 and the additional line portion 24. The guide line 9 is fixed to the leading edge 16 of the traction wing 5 by means of a disengageable clamping element 25 that here includes a jaw 26. The disengageable clamping element 25 is fixed to the leading edge 16, for example by stitching it to the traction wing 5, through the wall of the leading edge 16. The disengageable clamping element 25 includes a sleeve 37 formed here by a bore passing completely through it and through which the guide line 9 passes.

The jaw 26 is clamped by elastic means onto the guide line 9 so that the guide line 9 is engaged on the leading edge 16, in the same manner as in the first embodiment. The rest of the guide line 9 functions in the same manner as in the first embodiment, the slider 15 sliding along this guide line 9 as explained above.

Figure 12:
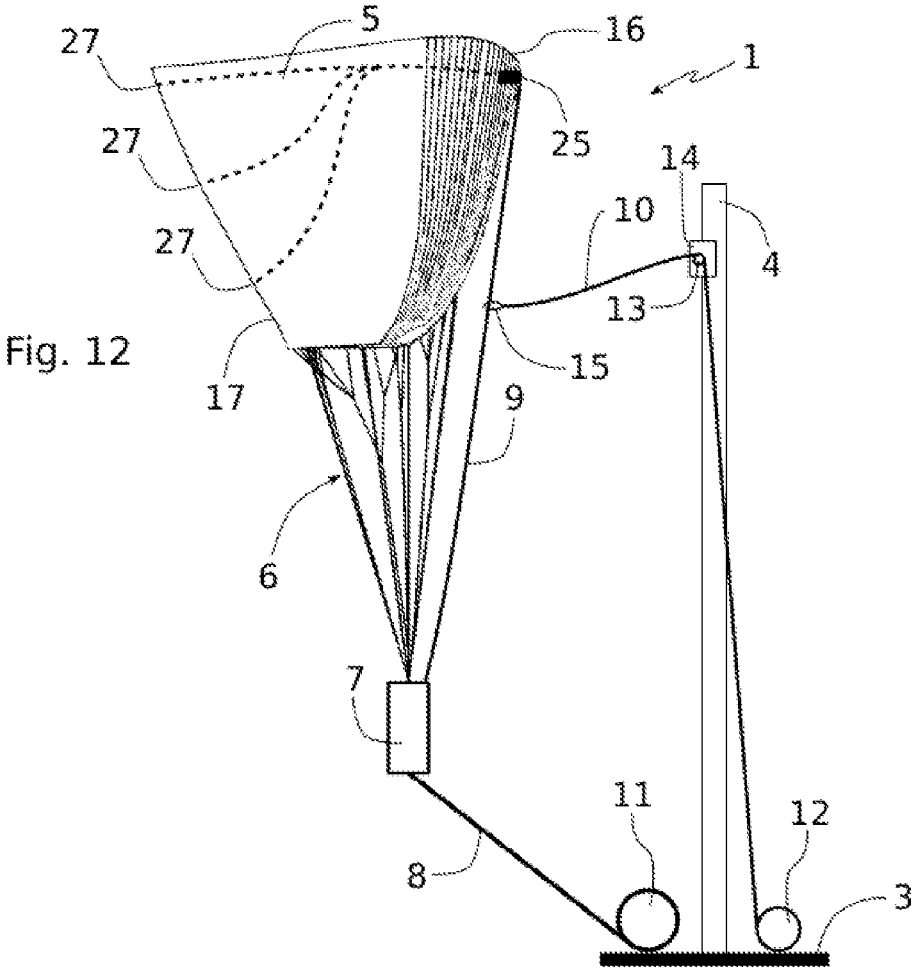
FIG. 12 is a schematic profile view of the captive wing traction system in accordance with the second embodiment.

FIG. 12 is a schematic profile view of the captive wing traction system 1 in this second embodiment. This figure depicts the disengageable clamping element 25 fixed to the leading edge 16 and immobilizing the guide line 9. The additional line portion 24 extends the guide line 9 beyond the leading edge 16, toward the interior of the traction wing 5. In the present example the additional line portion 24 is a line enabling closing of the trailing edge 17 of the traction wing 5. This additional line portion 24 is therefore divided into a plurality of lines the ends of which are fixed to trailing edge 17 at various points 27 so that traction on the additional line portion 24 leads to closing of the trailing edge 17 by moving various portions of the trailing edge 17 close together.

In the FIG. 12 example the stowage trolley 14, as well as carrying the deflector element 13, is adapted to be coupled to the disengageable clamping element 25. The stowage trolley 14 includes a locking member 22 the function of which is the same as in the first embodiment (locking the stowage line 10 on the guide line 9) and which here additionally enables locking of the disengageable clamping element 25.

Figure 13:
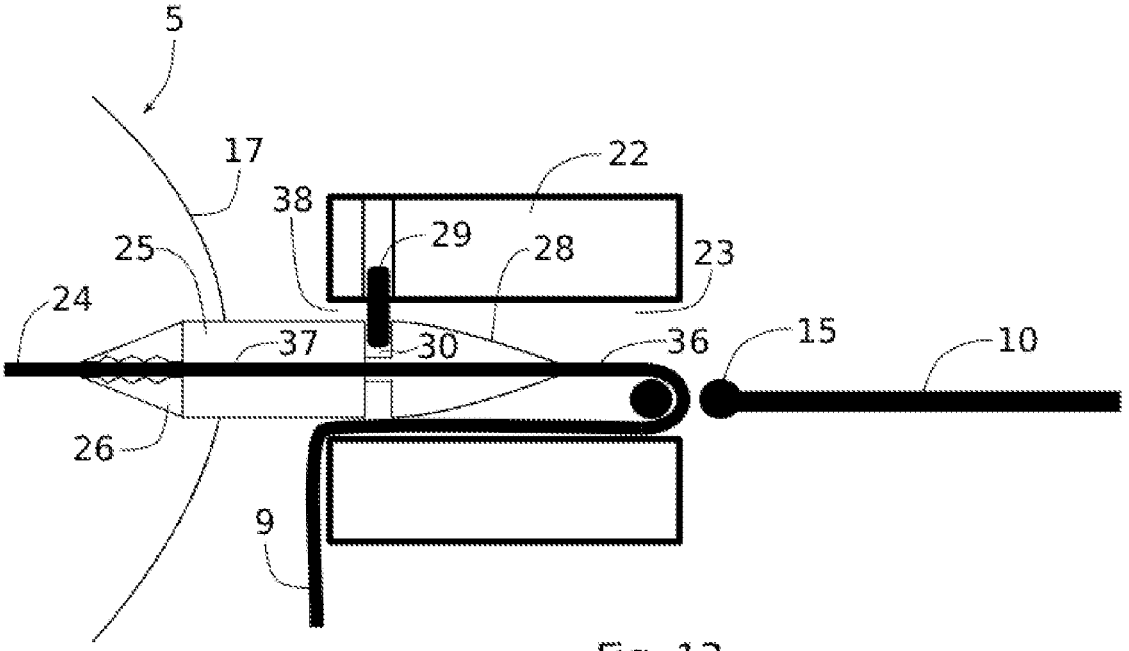
FIG. 13 depicts the functioning of the elements represented in FIG. 11.

FIG. 13 depicts schematically in section the locking member that is mounted on the stowage trolley 14 in this second embodiment.

On approaching the position corresponding to FIG. 6 the traction on the stowage line 10 during the stowage phase drives passage of the doubled over guide line 9 through the locking member 22 and coupling of the disengageable clamping element 25 in the locking member 22. The disengageable clamping member 25 takes up its place in an appropriate housing 38 of the locking member 22. In this example a tapered end 28 facilitates entry of the disengageable clamping element 25 into the housing 38. A latch 29 in this housing 38 is engaged in a groove 30 to lock the disengageable clamping element 25 in position. The latch 29 may be controlled by any appropriate, for example mechanical or electromagnetic, means.

FIG. 13 is a schematic view depicting general operation. In practise, the locking member 22 and the clamping element 25 could be any shape adapted to be coupled and providing a passage for the doubled over guide line 9, such as a groove.

This FIG. 13 position is maintained for the same stowage operations as in the first embodiment. Traction on the stowage line 10 drives traction on the leading edge 16 and the wing can therefore be held against the stowage mast 4 by its leading edge 16.

Figure 14:
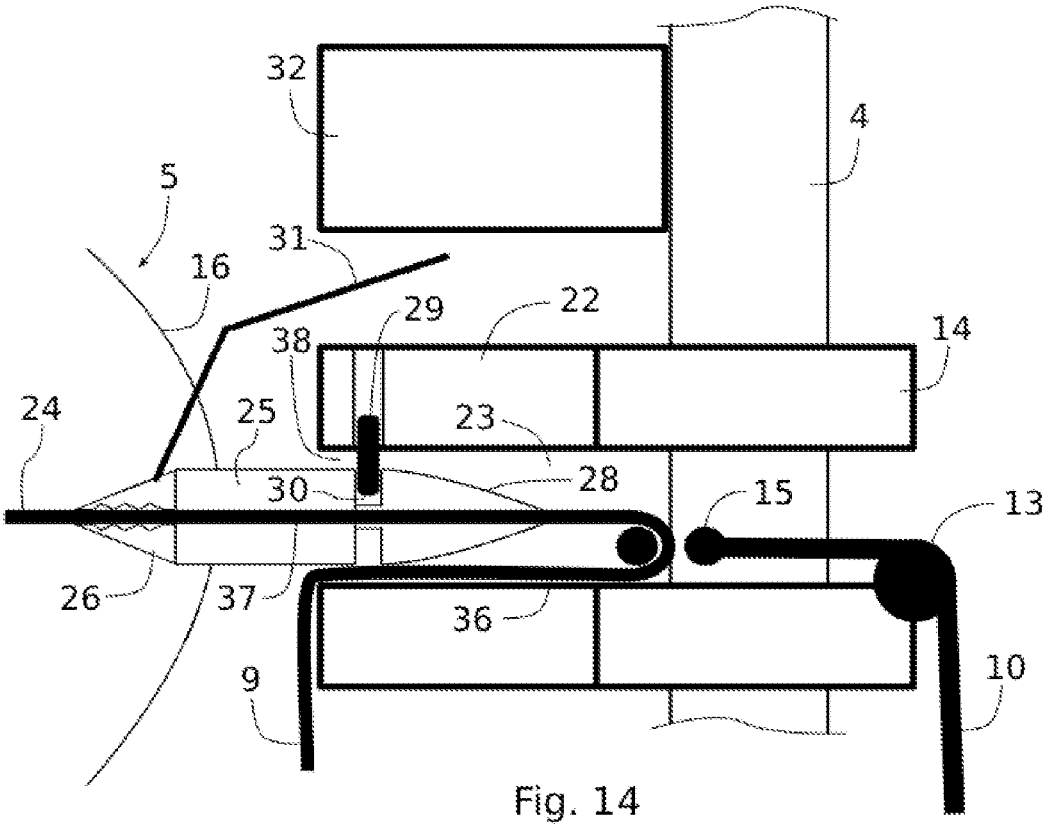
FIG. 14 depicts the functioning of the elements represented in FIG. 11.
Figure 15:
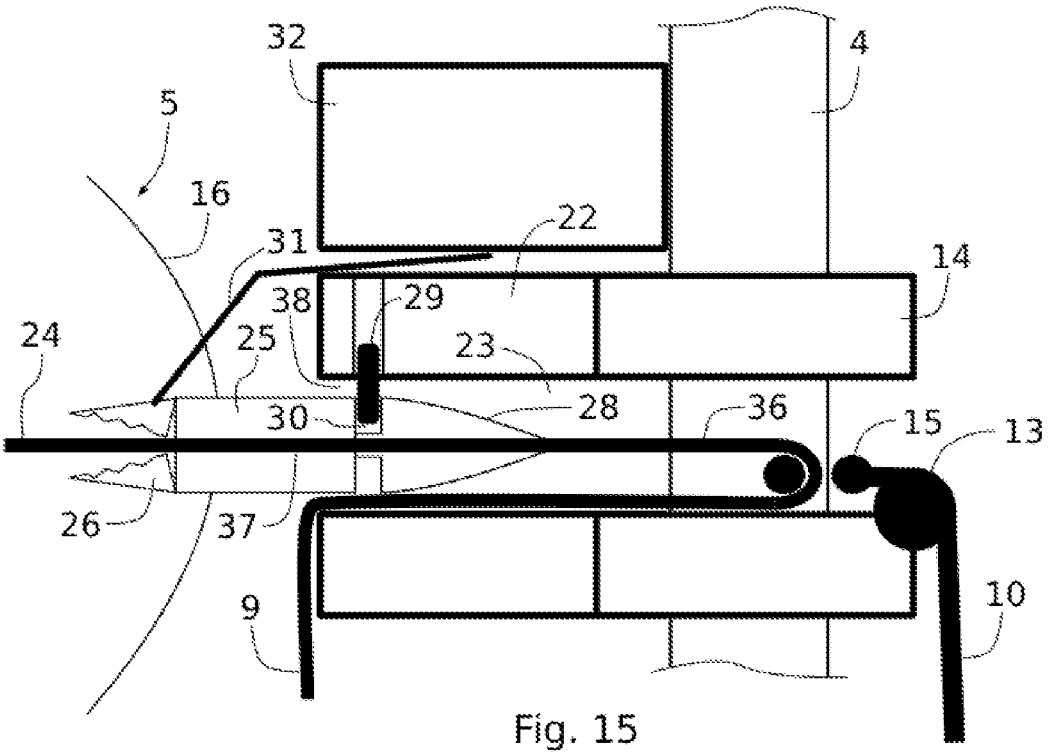
FIG. 15 depicts the functioning of the elements represented in FIG. 11.

Starting from the FIG. 13 position, this second embodiment further makes possible an additional function depicted in FIGS. 14 and 15.

In these FIGS. 14 and 15 the stowage trolley 14 includes a portion forming the locking member 22 and another portion carrying the deflector element 13. In this example the jaws 26 include actuating means depicted here by a lever 31 that enables opening of the jaws 26. The lever 31 is actuated by the approach of another trolley 32 that also slides on the stowage mast 4. Alternatively, the jaws 26 may be opened by any appropriate means, such as remote-controlled electromechanical means.

Starting from the FIG. 13 stowage position, a step of disengaging the disengageable clamping element 25 therefore consists in opening the jaws 26 by actuating the lever 31. The disengageable clamping element 25 therefore releases the guide line 9 (FIG. 15 position). Traction on the stowage line 10 can then continue through actuation of the winch 12, which drives traction on the guide line 9. The traction on the guide line 9 drives traction on the additional line portion 24, which is therefore pulled in the direction of the deflector element 13, given that the jaws 26 are open.

FIGS. 14 and 15 take into account the traction on the additional line portion 24 by virtue of the movement of the slider 15 in the direction of the deflector element 13. These schematic views depict a small amplitude of movement of the slider 15, given that in practise the device will be adapted to suit an amplitude conforming to the traction length required for the additional line portion 24, in particular by the choice of the position of the deflector element 13, the capacity of the slider 15 to pass beyond the deflector element 13, or any other arrangement.

Traction on the stowage line 10 by its winch 12 and therefore traction on the additional line portion 24 continues as long as necessary for the additional line portion 24 to fulfil its function.

In this regard FIG. 15 depicts the traction wing 5 in a stowage position, held against the stowage mast 4 by its leading edge 16, and folded on either side of the stowage mast 4 thanks to the various additional trolleys 19 that retain different suspension lines 6 or different dedicated folding lines. In this configuration, which applies during folding or deployment of the traction wing 5, the traction on the additional line portion 24 enables it to fulfil its function of moving closer together the trailing edges 17 of the traction wing 5 (depicted by the arrows 34). The additional line portion 24 may instead have any other function, for example a function of furling the traction wing 5 (depicted by the arrows 33).

Figure 16:
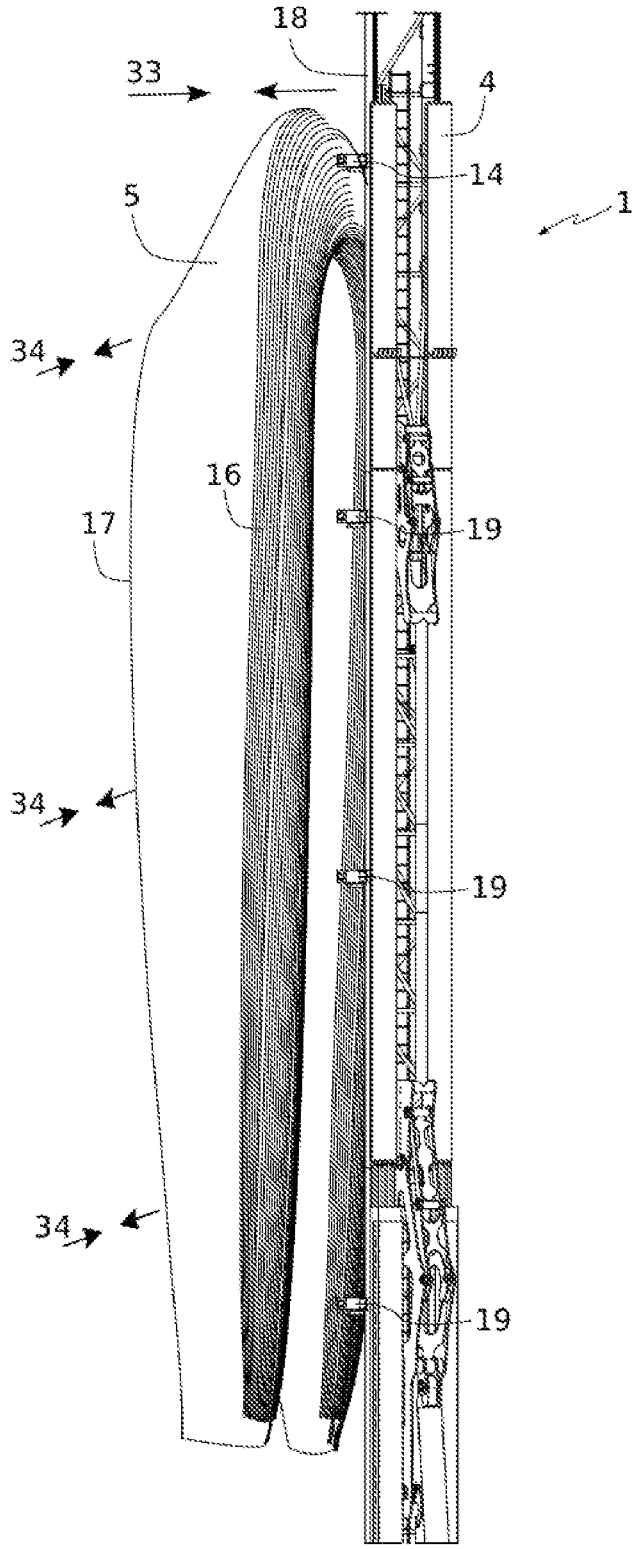
FIG. 16 depicts the traction wing of the traction device in accordance with the invention during folding along the stowage mast.

Starting from FIG. 16, during deployment of the traction wing 5 the stowage line 10 is first released by the winch 12 while the jaws 26 are opened so that the additional line portion 24 is released and the traction wing 5 assumes its flight shape, after which the traction wing 5 is unfolded by means of the additional trolleys 19 while the traction wing 5 remains held against the stowage mast 4 thanks to the tension maintained on the stowage line 10. The jaws 26 are closed, the additional line portion 24 having completed its task.

The stowage line 10 can then be released so that the traction wing 5 takes flight, as described for the first embodiment.

Moreover, in all embodiments the captive wing traction system 1 benefits from simplification of hauling down operations (concluding the folding of the traction wing 5) or hoisting operations (initiating the deployment of the traction wing 5). These operations are depicted in FIGS. 17 and 18 (the suspension lines have not been represented to simplify these figures).

Figure 17:
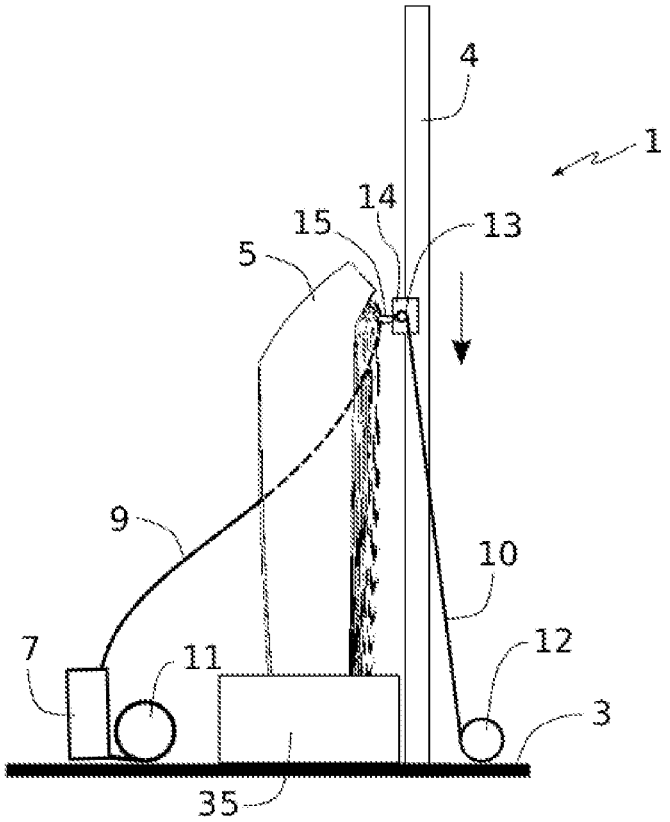
FIG. 17 depicts a step of hauling down the traction wing of the captive wing traction system.

FIG. 17 depicts the hauling down of the traction wing from its FIG. 16 position. The entire traction wing 5 has descended the stowage mast 4 to come to be stowed in an appropriate housing 35. This operation is carried out by causing the stowage trolley 14 to slide downward along the stowage mast 4 whilst maintaining the traction wing 5 in its stowed position. Here this is done by winding in the winch 12 so as to maintain the tension in the stowage line and therefore to hold the leading edge 16 against the stowage trolley 14. The stowage trolley 14 can itself be motorized to control its descent along the stowage mast 4, the winch 12 then accompanying its descent. Alternatively, the descent may be controlled entirely by winding in the winch 12.

Figure 18:
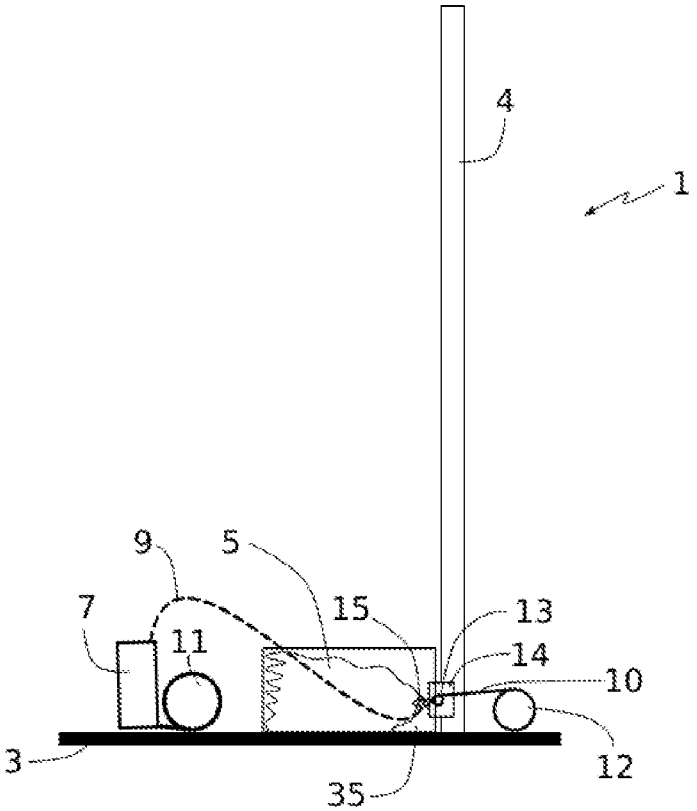
FIG. 18 depicts a hauling down step that follows the FIG. 17 step.

The hauling down of the traction wing 5 ends in the FIG. 18 position (in which the housing 35 is seen as by transparency). The traction wing 5 is entirely disposed in the housing 35, although the winch 12 maintains the tension on the stowage line 10 as far as that position.

For the reverse operation, during deployment of the traction wing 5, from the FIG. 18 position, the stowage trolley 14 is first hoisted along the stowage mast 4 while the winch 12 unwinds the stowage line 10 to accompany the upward movement of the stowage trolley 14 while maintaining a traction force on the stowage line 10 so that the stowage of the leading edge 16 is constantly maintained with the stowage trolley 14 during all of the operation of hoisting the traction wing 5.

FIGS. 19 to 25 relate to an embodiment in which the traction wing includes a capture device 122. In this embodiment the guide line 9 is a double line and the traction wing 5 includes a plurality of folding lines 110A, 110B, 110C that are all fastened to the leading edge 16 at one of their ends at least.

The traction wing 5 further includes a furling line 113 the ends of which are connected to the trailing edge 17 of the wing 5. This furling line 113 may be captured at the level of the capture device 122 and traction on this furling line 113 drives compression of the wing 5 with the aim of stowing it.

The traction system 1 includes folding trolleys (such as the additional trolleys 19 in FIG. 8). These trolleys are slidably fixed to the stowage mast 4 and each includes a drive system so that the position of each trolley along the stowage mast 4 can be controlled. These trolleys are adapted to capture and to guide the bending lines 110A, 110B, 110C and the furling line 113 during the deployment and folding phases.

Figure 19:
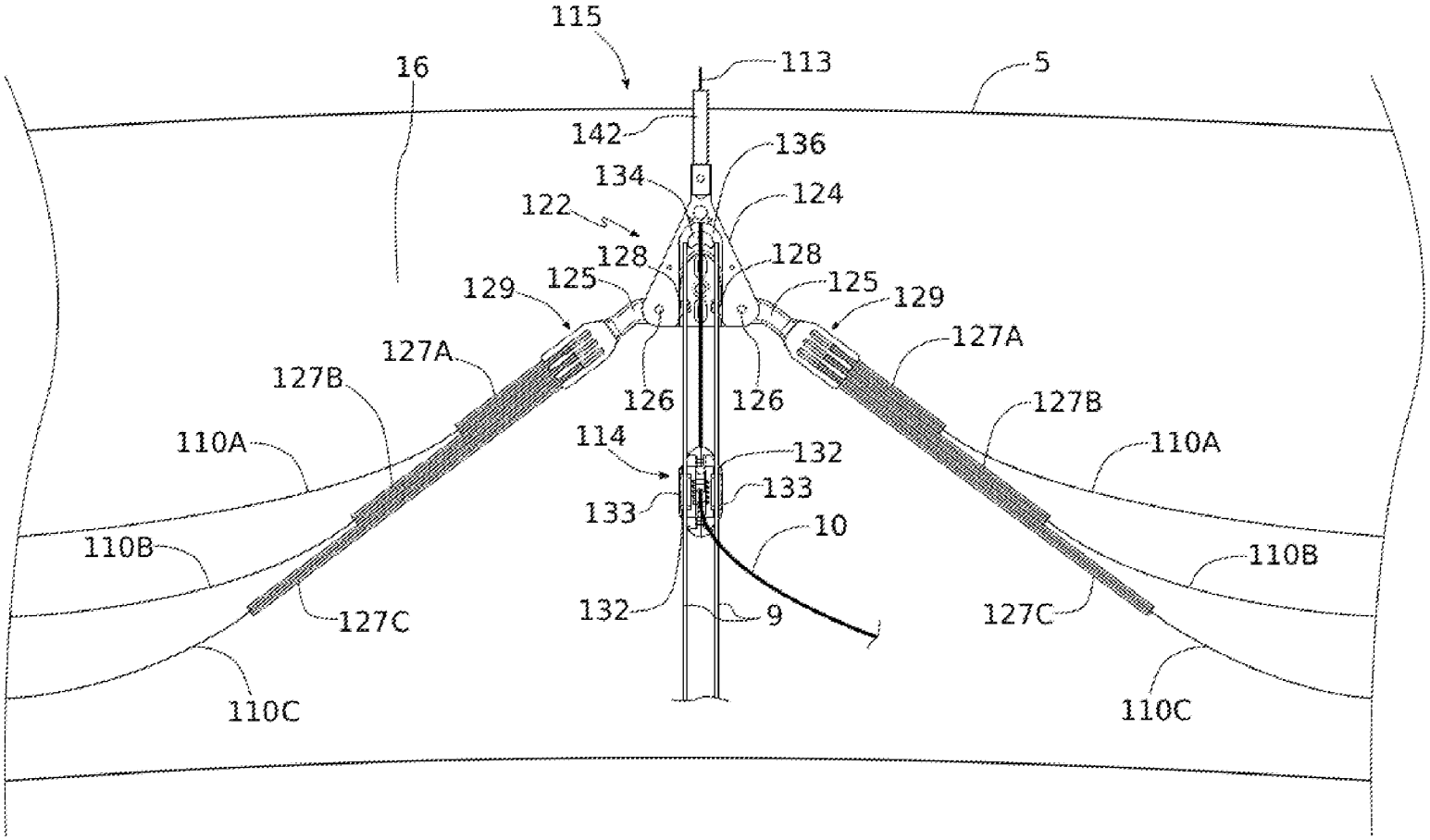
FIG. 19 is a view to a larger scale of the traction wing showing a capture device that is connected to the leading edge of the traction wing.

The folding lines 110A, 110B, 110C are arranged in pairs as depicted in FIG. 19.

FIG. 19 is a detail view depicting the traction wing 5 as seen from the front and showing the median zone 115 of its leading edge 16.

Figure 22:
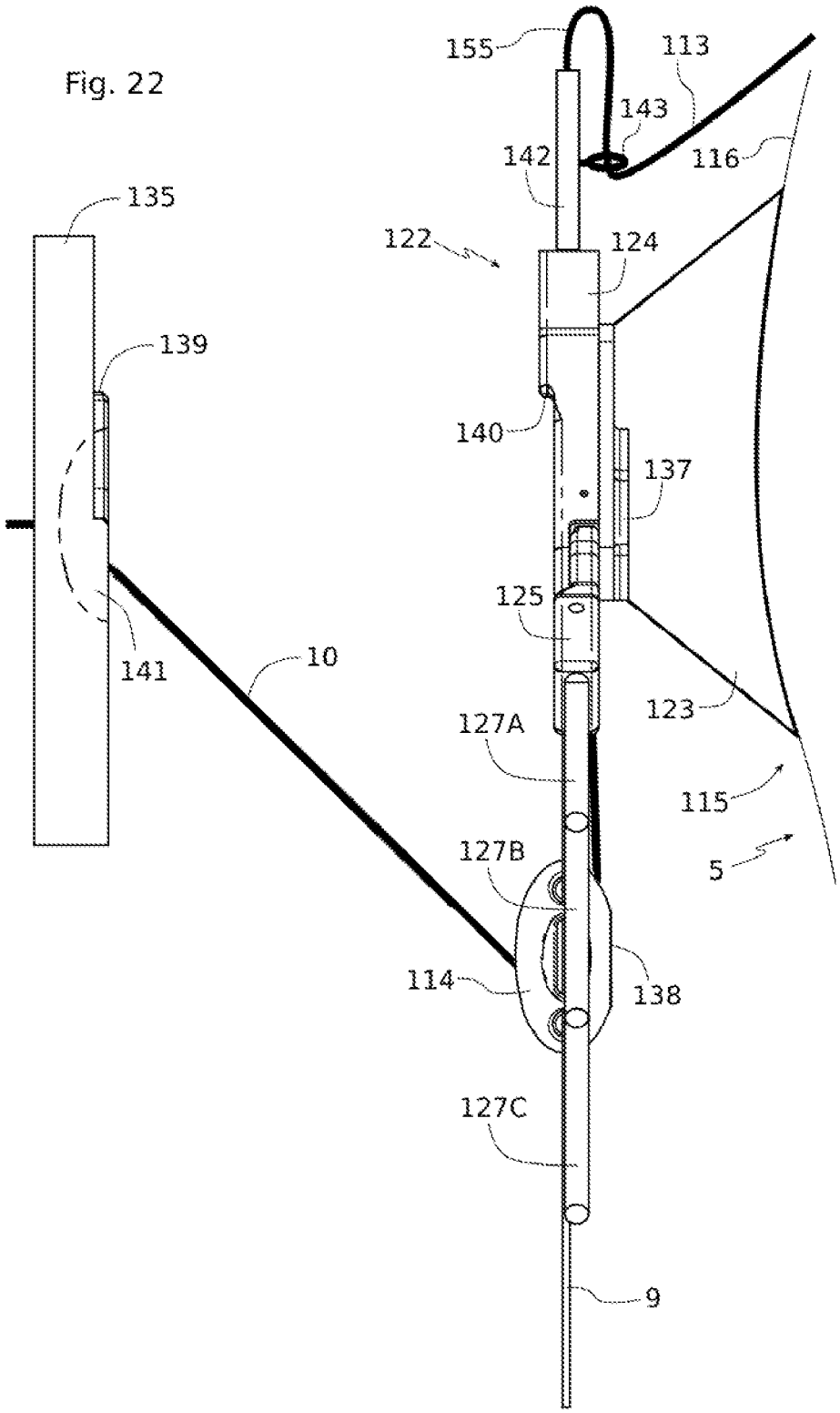
FIG. 22 is a side view of the capture device.

Here the system includes a capture device 122 that is connected to the leading edge 16 of the traction wing 5 at the level of the median zone 115 by a pylon 123 (seen in particular in the FIG. 22 side view). The pylon 123 is so-called by analogy with the pylon of an aircraft, that is to say the jet engine pylon, to use aeronautical terminology. The pylon 123 is preferably a rib of lightweight and strong material such as a carbon fibre composite material. The pylon 123 is fixed to the capture device 122 and to a reinforcement stitched onto the leading edge 16 of the traction wing 5.

Alternatively, the capture device 122 may be connected to the leading edge 16 by any other flexible or rigid means, such as textile links or any other element enabling traction on the capture device 122 to drive traction on the leading edge 16.

The capture device 122 includes a body 124 and two attachment arms 125 each mounted to pivot on the body 124 about an axis 126. Each of the attachment arms 125 includes a first attachment rod 127A, a second attachment rod 127B of greater length, and a third attachment rod 127C of even greater length (the attachments rods 127A, 127B, 127C are seen in section in FIG. 19). This arrangement in which the juxtaposed attachment rods have an increasing or decreasing length is referred to here as a "staircase".

In the present example the attachment rods 127A, 127B, 127C consist of tubes force-fitted in bores provided for this purpose in the attachment arm 125.

The attachment arms are mobile relative to the body 124 between a flight position (that in FIG. 19) and an attachment position (that in FIG. 23) in which the attachment rods 127A, 127B, 127C are disposed substantially vertically (when the traction wing 5 is in its normal stowage position).

Each attachment arm 125 further includes a lever 128, that is to say a portion extending beyond the axis 126 and enabling action on the attachment arm 125 to fold it.

This folding line 110A, 110B, 110D, 110C that joins the median zone 115 is connected to an attachment rod 127A, 127B, 127C so as to project in line with that attachment rod. In other words, the end of the attachment rod is extended by the folding line.

In the present example, in which the attachment rods are tubes, the folding line is advantageously inserted in the tube and passes completely through the tube as far as a fixing zone 129 of the attachment arm 125.

The pivot connection between the attachment arms 125 and the body 124 enables the attachment arm 125 naturally to assume the moved apart position depicted in FIG. 19 during flight of the traction wing 5, the attachment arms 125 therefore following the opening dictated by the folding lines 110A, 110B, 110C that extend in the direction of their other end connected further on to the leading edge 16. The capture device 122 may further include an elastic element (spring or the like) urging the attachment arms 125 towards their FIG. 19 flight position.

The function of this flight position of the attachment arms 125 is to make the automatic attachment of the lines more secure by limiting the risk of tangling of the attachment arms 125 and the attachment rods 127A, 127B, 127C with the other lines such as the guide line 9 and the stowage line 10.

In this embodiment the slider 15 includes a shuttle 114 (also depicted in section in FIG. 19). The shuttle 114 includes two sliding orifices 132 here of oblong shape with two lateral flats 133. The oblong shape of the shuttle 114 enables angular orientation (about a horizontal axis) and guidance of the capture device 122.

Here the guide line 9 consists of a pair of taut lines between the body 124 and the trajectory control flying device 7. In the present example the pair of guide lines 9 forms a loop around an abutment 134 of the body 124.

The guide line 9 is therefore attached to the median zone 115 by means of the capture device 122.

The stowage line 10 passes through the shuttle 114 and is connected to the body 124. The shuttle 114 includes guide means through which the stowage line 10 passes enabling the stowage line 10 to slide freely. In the present example this guide means is a pulley 63 (see FIG. 24) and may alternatively be any type of guide means, such as pulleys or low-friction elements. The stowage line 10 therefore extends from the stowage trolley 14 and slides through the shuttle 114, being guided in the direction of the body 124.

Figure 20:
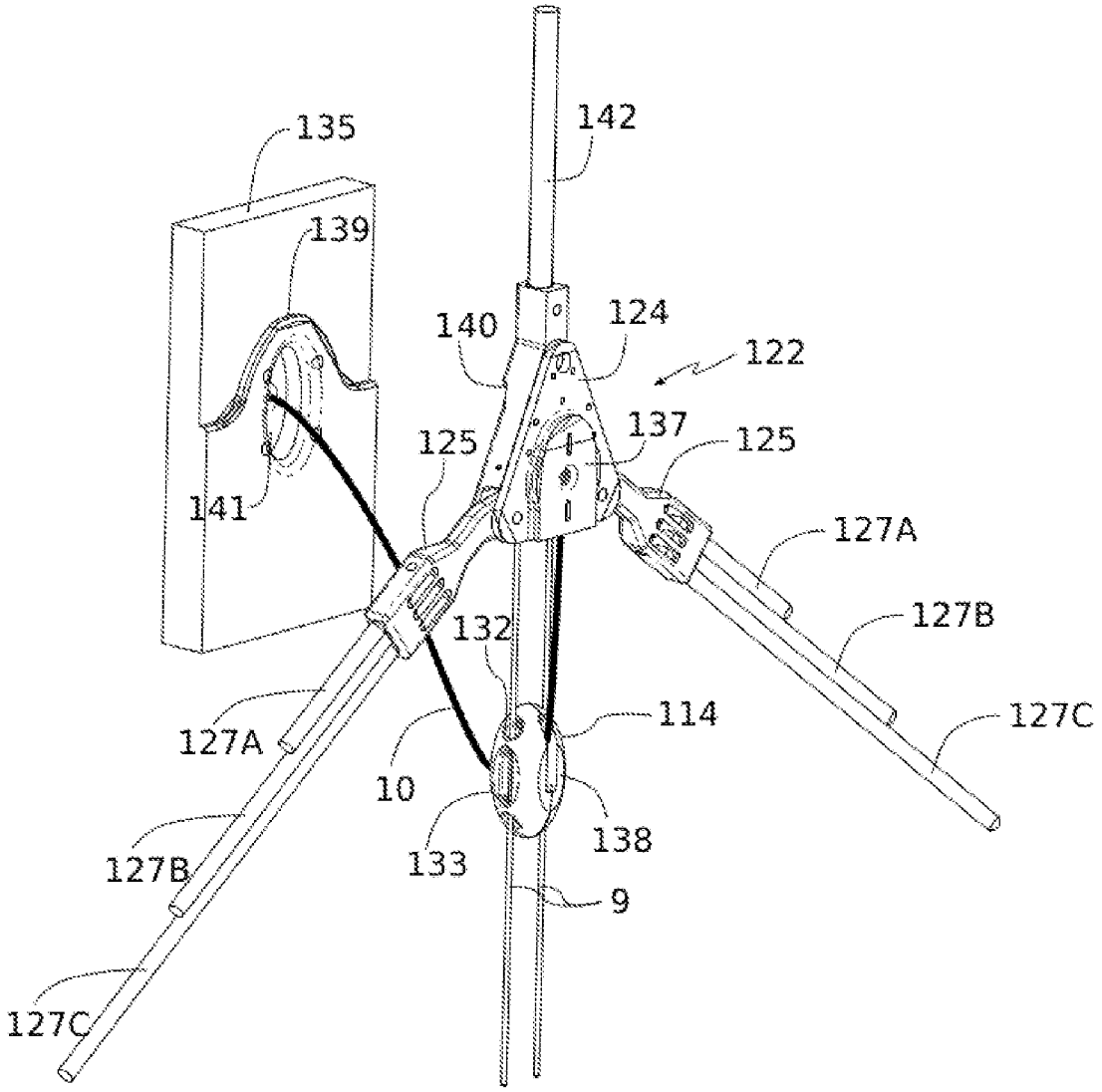
FIG. 20 is a perspective view of the capture device.
Figure 21:
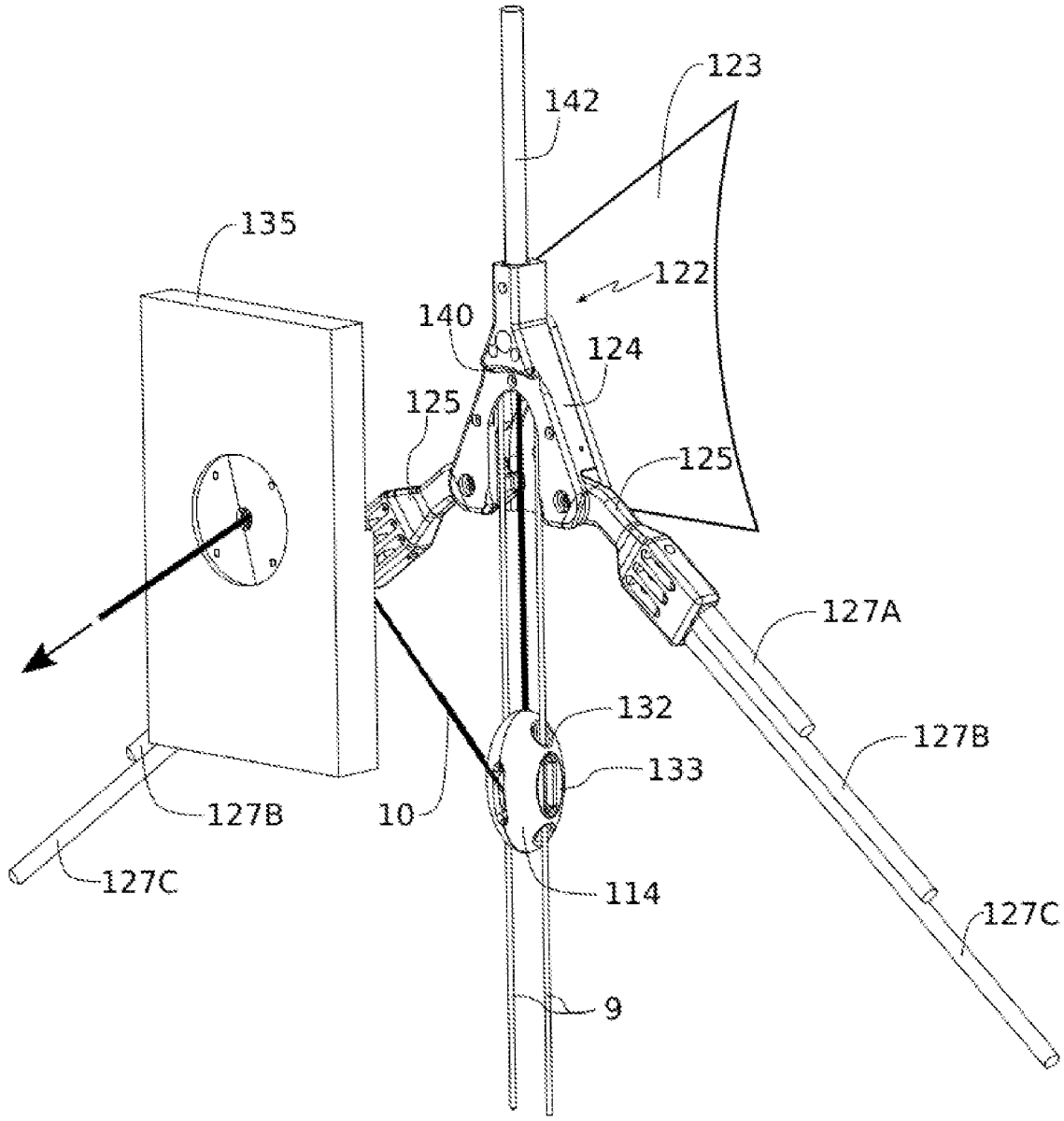
FIG. 21 is another perspective view of the capture device.

FIGS. 20 and 21 depict the capture device 122 in perspective from two different viewing angles. In FIG. 20 the face of the capture device 122 that can be seen is that which faces toward the traction wing 5 (the pylon 123 has not been represented).

In FIG. 21 the visible face of the capture device 122 is that facing toward the stowage trolley 14.

The capture device 122 is represented facing a nesting interface 135 that is fixed to the stowage trolley 14 (the rest of the stowage trolley 14 has not been represented).

The FIGS. 20 and 21 position depicts an intermediate position during the operation of stowing the traction wing 5 during folding thereof. In this position the traction line 8 has caused the leading edge 16 of the traction wing 5 to face the stowage trolley 14 and the stowage line 10 is being wound in by its winch 12, traction then being exerted on the stowage line 10.

This operation causes the shuttle 114 to rise up the guideline 9. Here the doubling over of the guide line 9 enables sliding of the shuttle 114 without pivoting about a vertical axis. A sliding connection is therefore provided, instead of a pivoting sliding connection.

The capture device 122 includes at the level of the body 124 a housing 136 intended to receive the shuttle 114. The housing 136 is delimited by its lateral walls cooperating with the two flats 133 of the shuttle 114 and by a bottom wall 137 itself cooperating with another flat 138 on the shuttle 114.

FIG. 22 depicts the parts from FIGS. 20 and 21 as seen in profile. The nesting interface 135 includes elements enabling stowage of the capture device 122 in a predefined position. In the present example these elements include a step 139 that is complementary to a step 140 on the body 124. The shuttle 114 is also part of these positioning elements, because it is adapted to be engaged in an imprint 141 of the nesting interface 135. The step 140 moreover has a great advantage in terms of absorbing forces because the cooperation of the steps 139 and 140 makes it possible to absorb all of the vertical forces exerted on the capture device 122 during folding operations, which forces can exceed 15 kN.

The imprint 141 includes internal walls enabling the shutter 114 to be received and positioned. The oval shape of the shuttle 114 and its complement in the shape of the imprint 141 guarantee predefined positioning of the capture device 122 on the nesting interface 135 during stowage.

FIG. 22 also depicts the arrangement of the furling line 113. The capture device 122 includes a furling rod 142 projecting vertically through the top of the body 124. The furling line 113 projects in line with the furling rod 124. In the present example the furling rod 142 takes the form of a tube fitted into the body 124, the furling line passing through this tube with its end fixed to the body 124.

Between its attachment to the furling rod 142 and its path in the direction of the trailing edge 17 the furling line 113 forms a loop 155 and enters a ring 143 that is fastened to the tube 142. The ring 143 is a low-friction ring for example or may take the form of a tube or a pulley. Traction on the loop 55 therefore drives traction on the furling line 113 and therefore furling of the traction wing 5.

Figure 23:
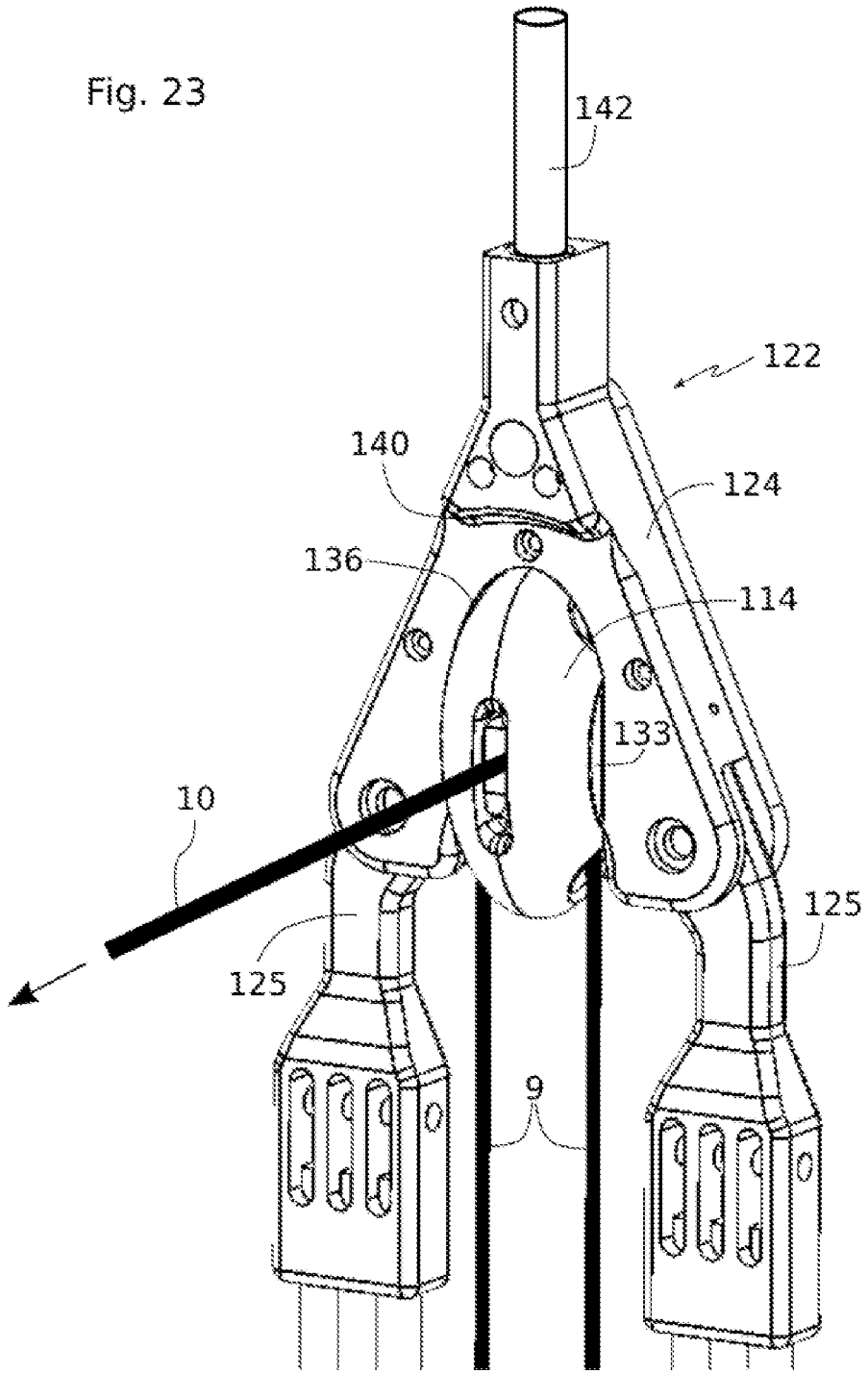
FIG. 23 is a partial view in perspective of the capture device.

Moreover, the traction on the stowage line 10 during the phase of stowage of the traction wing 5 causes the shuttle 114 to rise and ends with the entry of the shuttle 114 into the housing 136, as depicted in FIG. 23. The shuttle 114 is then immobilized in the housing 136 thanks to the dimensional fit enabling plane on plane bearing of the flats 133, 138 against internal surfaces of the housing 136.

The shuttle 114 is therefore mobile between a sliding configuration in which it slides along the guide line 9 and a stowage configuration in which the shuttle 114 is disposed in its housing 136.

The entry of the shuttle 114 into the housing 136 also activates the levers 128, which drives the closing of the attachment arms 125, that is to say their movement into the vertical position, and retention thereof in that position by virtue of the presence of the shuttle 114.

When the capture device 122 and the shuttle 114 are in the FIG. 23 position continuing traction on the stowage line 10 drives the movement of the capture device 122 closer to the nesting interface 135 until these two elements are coupled.

The coupling of the capture device 122 and of the nesting interface 135 is effected in the predetermined position required by the nesting in the steps 139, 140 and by the nesting of the shuttle 114 in the imprint 141. The oval shape of the shuttle 114 enables the capture device 122 to be returned to this predetermined position during stowage, even in the event of twisting of the stowage line 10, that is to say even in the event of rotation of the capture device 122 about the stowage line 10. The convex shape of the shuttle 114 is thus adapted to be housed in a concave shape of the nesting interface 135 when the shuttle 114 is in the stowage configuration, the shuttle 114 if necessary driving rotation of the assembly formed by the capture device 122 and the shuttle 114 thanks to the oval shape of the shuttle 114 and because of traction by the stowage line 10.

Figure 24:
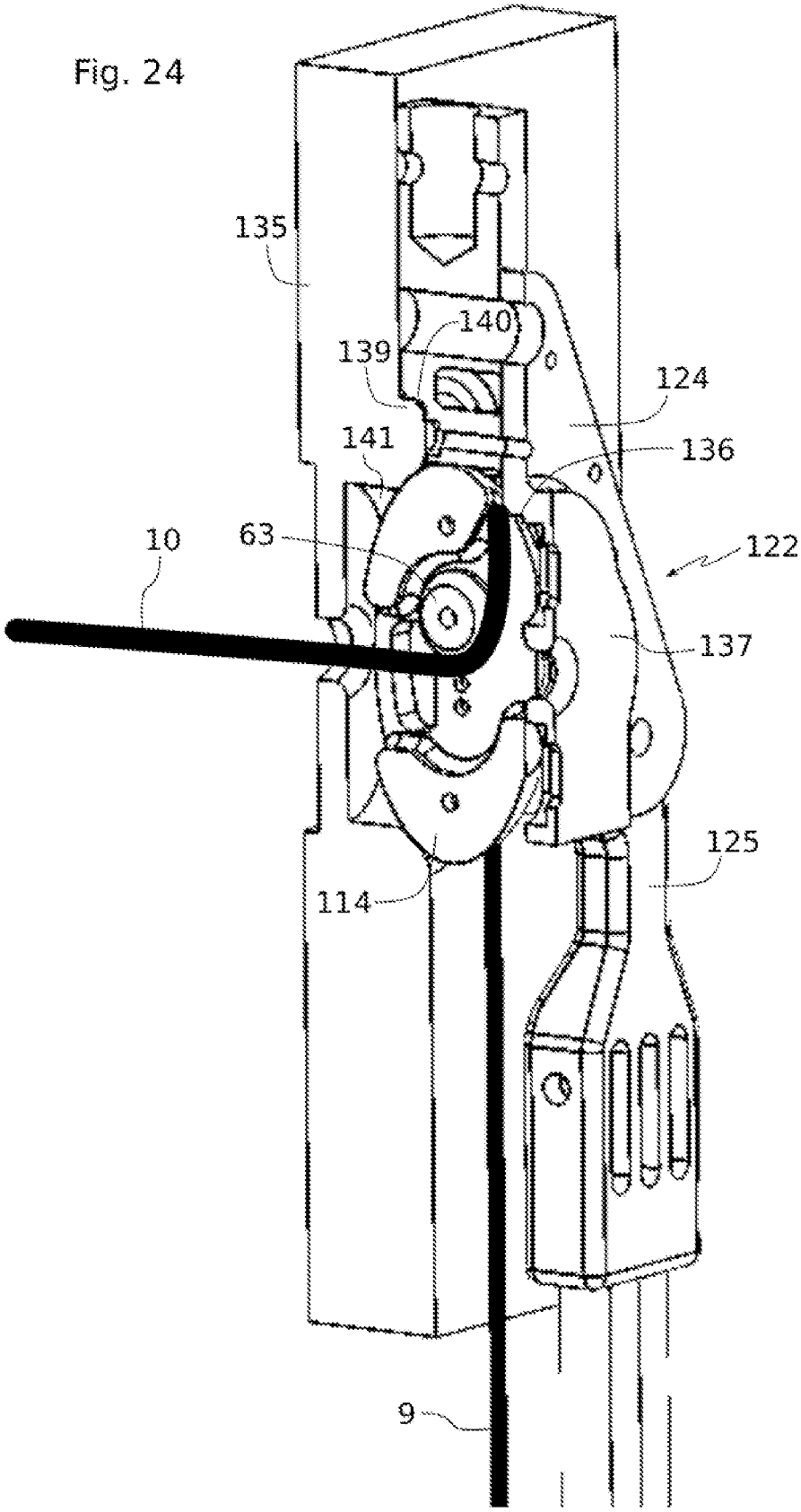
FIG. 24 is a view in section of FIG. 23.

FIG. 24 is a view in section of the capture device 122 (and of the shuttle 114) after it is coupled to the nesting interface 135. In this position the leading edge 16 of the traction wing 5 is moored to the stowage trolley 14 by means of the capture device 122. Maintaining a traction force on the stowage line 10 no longer drives movement of the capture device 122 (which is abutted against the nesting interface) but maintains the stowage.

The system further includes immobilization means (not represented) mobile between a retracted position in which they are moved away from the capture device 122 and then an immobilization position in which they immobilize the capture device 122 against the nesting interface 135.

During the process of folding the traction wing 5, as soon as the capture device 122 is coupled to the nesting interface 135 the immobilization means are activated to go to their immobilization position to fix the capture device 122 to the nesting interface 135. Starting from this step traction on the stowage line 10 is no longer necessary to maintain the stowage.

A variant directed to the arrangement of the stowage line 10 will now be described with reference to FIG. 25. In accordance with this variant the stowage line 10 is not permanently attached to the body 124 and enables an additional function to be provided.

Figure 25:
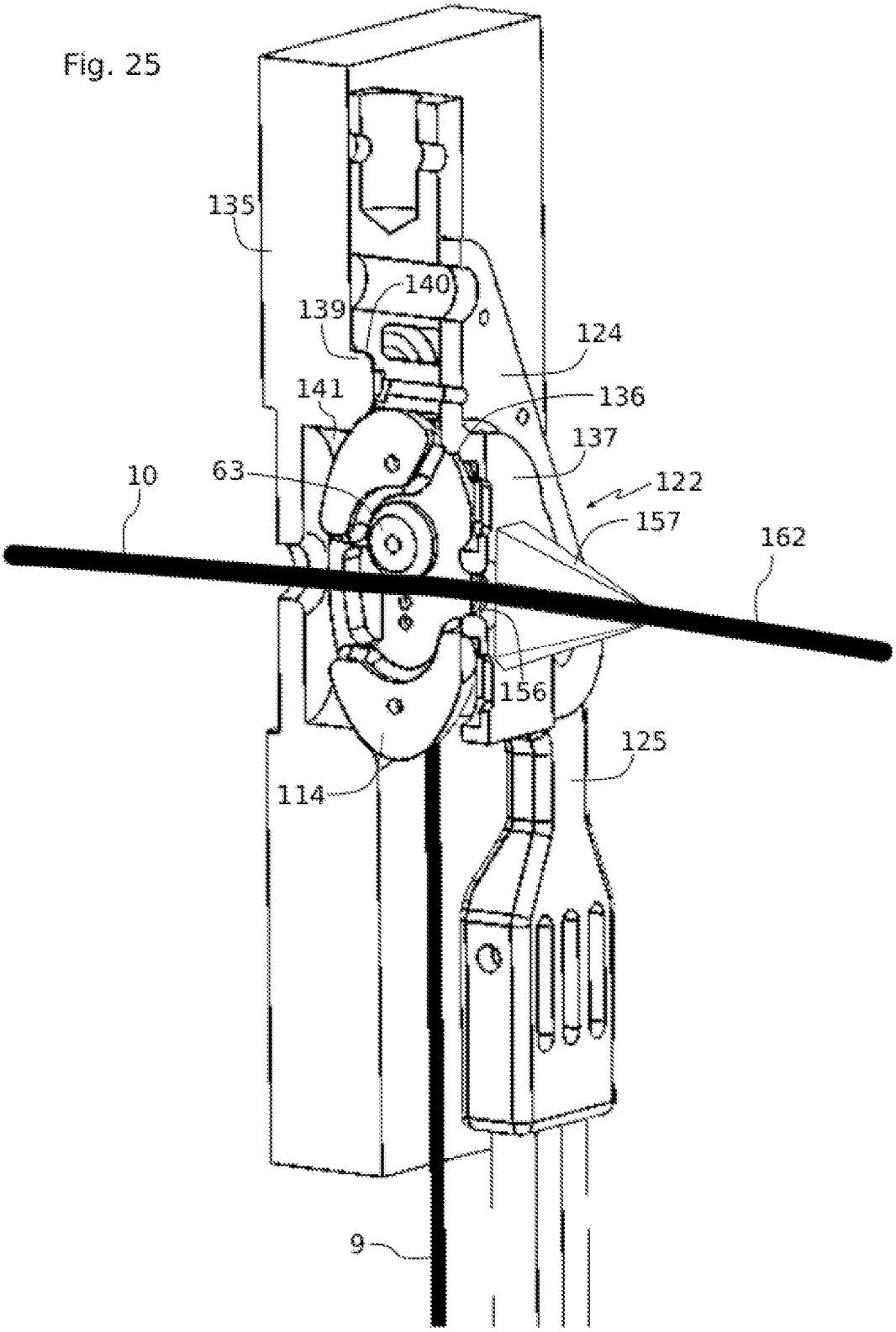
FIG. 25 is similar to FIG. 24 for a variant of the capture device.

For this variant FIG. 25 corresponds to FIG. 24 as described above. The stowage line 10 passes through an orifice 156 in the bottom wall 137 of the body 124 and is extended by an additional portion 162 in the direction of the traction wing 5. Where it exits the orifice 156 the stowage line 10 is fixed by a clamping means that here includes jaws 157 held closed by elastic elements.

The capture device 122 therefore includes a clamping means adapted to occupy a clamping position in which the stowage line 10 remains fixed to the capture device 122 and to occupy a releasing position in which the stowage line 10 slides freely relative to the capture device 10.

Extending the stowage line 10 beyond the jaws 157 enables this additional portion 162 of the stowage line 10 to provide an additional function in the traction wing 5. That function may for example relate to action on the aerodynamic profile of the traction wing 5 or to an action of closing the trailing edge of the traction wing 5.

This additional function is performed by commanding opening of the jaws 157 and exerting traction on the stowage line 10, which drives traction on this additional portion 162 of the traction line 10 and therefore execution of this additional function, for example by traction modifying the shape of the trailing edge 17.

The jaws 157 are commanded to open after the capture device 122 has been immobilized so that the traction on the stowage line 10 is no longer of any utility for maintaining stowage.

Figure 26:
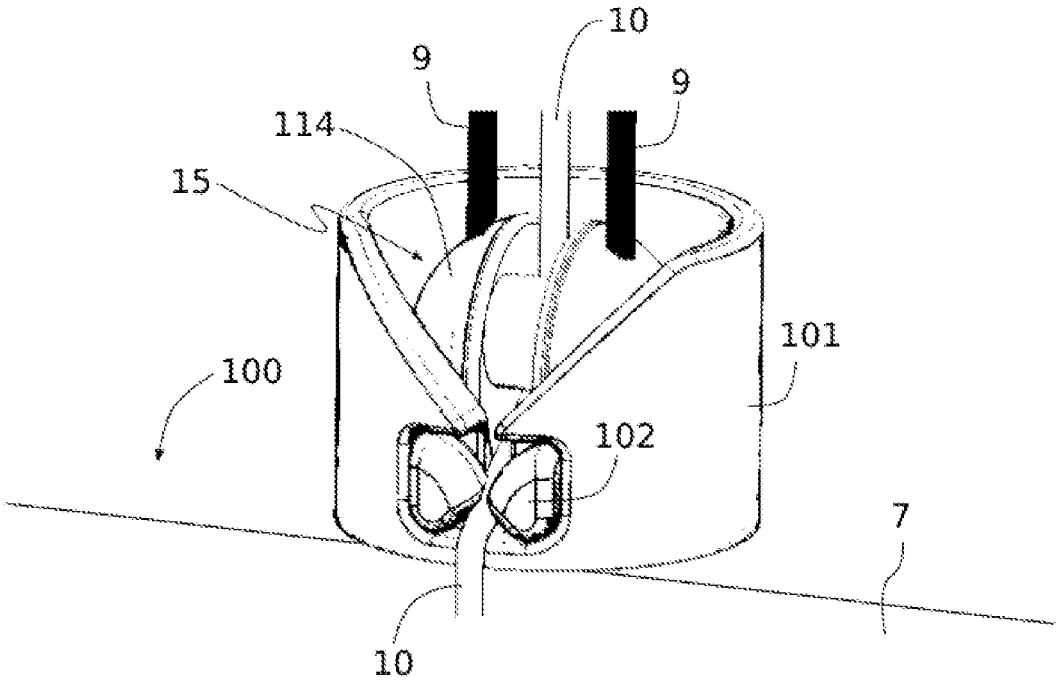
FIG. 26 depicts an example of a receptacle adapted to receive the slider during flight phases.

FIG. 26 depicts an example of a receptacle adapted to receive the slider 15 during flight phases. This receptacle 101 is fixed to the upper face 100 of the trajectory control flying device 7. Here the receptacle 101 is formed by a cylindrical housing matched to the shape of the slider 15, which in the present example includes a shuttle 114 similar to that of the preceding embodiment, with a doubled over guide line 9. During deployment of the traction wing 5, when the slider 15 reaches its end of travel position on sliding along the guide line 9 in the direction of the device 7, it comes to take up its place in the receptacle 101.

Moreover, locking means are provided to immobilize the stowage line 10 and the slider 15 in the receptacle 101. In the present example these means are passive and consist of a line immobilizer 102 including elastic means moving the two jaws closer together. When the stowage line 10 is subjected to downward traction, even slight downward traction (because of its own weight for example), it comes to be immobilized in the immobilizer 102. Conversely, when the traction wing is in the folding phase, the stowage line 10 will be subjected to upward traction (during movement of the traction wing 5 closer to the stowage mast 4), which will cause the stowage line 10 to be extracted from the immobilizer 102.

Alternatively, these locking means may be active and for example consist of a controlled actuator capable of immobilizing the slider 5 directly in its receptacle or immobilizing the stowage line.

Thanks to the receptacle 101 the stowage line 10 rests entirely and in a secure manner on the trajectory control flying device 7. The weight of and the drag on the stowage line 10 therefore do not disturb the leading edge 16 of the traction wing 5 during flight phases.

Variant embodiments of the captive wing traction system 1 may be used. The embodiments and the variants may in particular be combined.

The invention claimed is:

1. A captive wing traction system (1) comprising;

a traction wing (5) to generate a traction force because of the effect of the wind and is deployed and folded relative to a base platform (3) that is provided with a stowage mast (4), the traction wing (5) having a leading edge (16) and a trailing edge (17), a trajectory control flying device (7) attached to the traction wing (5) by fixed suspension lines (6) and mobile suspension lines (6*b*), the trajectory control flying device (7) controls the mobile suspension lines (6*b*);

a traction line (8) connecting the trajectory control flying device (7) to the base platform (3);

a guide line (9) that connects the leading edge (16) of the traction wing (5) to the trajectory control flying device (7);

a stowage line (10) one end of which is connected to the base platform (3) and that is connected in a sliding manner to the guide line (9) by a slider (15) fixed onto the stowage line (10) and with a pivoting sliding connection to the guide line (9);

a deflector element (13) that is attached to the stowage mast (4) and through which the stowage line (10) is routed between its first end and its connection to the guide line (9).

2. The captive wing traction system as claimed in claim 1, wherein the slider (15) includes a shuttle (114) sliding along the guide line (9), the shuttle (114) including a guide device (63) through which the stowage line (10) passes.

3. The captive wing traction system as claimed in claim 2, wherein the guide line (9) includes a double line and in that the shuttle (114) is slidably mounted on that double line.

4. The captive wing traction system as claimed in claim 2, wherein the trajectory control flying device (7) includes a receptacle (101) to receive the slider (15), the receptacle (101) including an immobilizer (102) for the stowage line (10).

5. The captive wing traction system as claimed in claim 1, wherein the traction line (8) is attached to the base platform (3) by a first winch (11) to adjust the length of the traction line (8) and the stowage line (10) is attached to the base platform (3) by a second winch (12) to adjust the length of the stowage line (10).

6. The captive wing traction system as claimed in claim 1, wherein the deflector element (13) is mounted on a stowage trolley (14) sliding along the stowage mast (4).

7. The captive wing traction system as claimed in claim 1, further including a retaining device for retaining the end of the stowage line (10) on the guide line (9), the retaining device being adapted to occupy: a free position in which the end of the stowage line (10) slides freely along the guide line (9) and a retaining position in which the end of the stowage line (10) is disposed in a loop formed by the guide line (9).

8. The captive wing traction system as claimed in claim 7, wherein said retaining device include a blocking member (22) that is adapted, in a retaining position, to form on the guide line (9) a loop (36) for retaining the stowage line (10).

9. The captive wing traction system as claimed in claim 8, wherein the blocking member (22) includes a through-passage (23) in which the stowage line (10) is passed when the retaining device are in the free position and in which the guide line (9) is passed doubled over when the retaining device are in the locked position.

10. The captive wing traction system as claimed in claim 1, wherein the guide line (9) is connected to the leading edge (16) of the traction wing (5) by a disengageable clamping element (25) fastened to the leading edge (16) of the traction wing (5), the disengageable clamping element (25) being adapted to retain the guide line (9) by clamping it.

11. The captive wing traction system as claimed in claim 10, wherein the disengageable clamping element (25) includes a sleeve (37) through which the guide line (9) is passed and the guide line (9) is extended by an additional line portion (24) extending beyond the leading edge (16) of the traction wing (5).

12. The captive wing traction system as claimed in claim 11, wherein the additional line portion (24) is connected to the trailing edge (17) of the traction wing (5).

13. The captive wing traction system as claimed in claim 10, further including a blocking member (22) that is adapted, in a retaining position, to form on the guide line (9) a loop (36) for retaining the stowage line (10), wherein the blocking member (22) includes a housing (38) adapted to receive the disengageable clamping element (25).

14. The captive wing traction system as claimed in claim 13, wherein said housing (38) includes a latch (29) for retaining the disengageable clamping element (25).

15. The captive wing traction system as claimed in claim 1, further including:

a plurality of folding lines (110A, 110B, 110C) each having an end fixed to the leading edge (16) of the traction wing (5) and being spaced from one another along that leading edge (16);

an additional trolley (19) adapted to slide along the stowage mast (4);

a capture device (122) that is attached to the leading edge (16) of the traction wing (5) and includes an attachment arm (125) provided with an attachment rod (127A, 127B, 127C), one of the folding lines (110A, 110B, 110C) projecting in line with the attachment rod (127A, 127B, 127C);

the stowage line (10) having one end connected to the capture device (122).

16. The captive wing traction system as claimed in claim 15, wherein the slider (15) includes a shuttle (114) sliding along the guide line (9), the shuttle (114) including a guide device (63) through which the stowage line (10) passes, wherein the capture device (122) includes a housing (136) for the shuttle (114), the shuttle (114) being mobile between a sliding configuration in which it slides along the guide line (9) and a stowage configuration in which the shuttle (114) is disposed in its housing (136).

17. The captive wing traction system as claimed in claim 16, wherein the capture device (122) includes a lever (128) controlling pivoting of the attachment arm (125) toward its attachment position, the lever (128) is actuated by the shuttle (114) when returning to the stowage configuration.

18. The captive wing traction system as claimed in claim 15, wherein the deflector element (13) is mounted on a stowage trolley (14) sliding along the stowage mast (4), wherein the stowage trolley (14) includes a nesting interface (135) for the capture device (122).

19. The captive wing traction system as claimed in claim 18, wherein the stowage trolley (14) includes an immobilizing device for immobilizing the capture device (122) against the nesting interface (135).

20. The captive wing traction system as claimed in claim 18, wherein the capture device (122) includes a housing (136) for the shuttle (114), the shuttle (114) being mobile between a sliding configuration in which it slides along the guide line (9) and a stowage configuration in which the shuttle (114) is disposed in its housing (136), wherein the shuttle (114) has a convex shape adapted to be housed in a concave shape of the nesting interface (135) when the shuttle (114) is in the stowage configuration.

21. A method of controlling a captive wing traction system of claim 5, wherein the method comprises a phase of deploying and a phase of folding a traction wing (5) in which the second winch (12) is controlled conjointly with the first winch (11) so that the end of the stowage line (10) slides along the guide line (9) while the trajectory control flying device (7) is moved away from or toward the base platform (3).

22. The method as claimed in claim 21 of controlling a captive wing traction system including the traction wing (5) to generate a traction force because of the effect of the wind and is deployed and folded relative to a base platform (3) that is provided with a stowage mast (4), the traction wing (5) having a leading edge (16) and a trailing edge (17), a trajectory control flying device (7) attached to the traction wing (5) by fixed suspension lines (6) and mobile suspension lines (6*b*), the trajectory control flying device (7) controls the mobile suspension lines (6*b*); a traction line (8) connecting the trajectory control flying device (7) to the base platform (3); the guide line (9) that connects the leading edge (16) of the traction wing (5) to the trajectory control flying device (7); a stowage line (10) one end of which is connected to the base platform (3) and that is connected in a sliding manner to the guide line (9) by a slider (15) fixed onto the stowage line (10) and with a pivoting sliding connection to the guide line (9); a deflector element (13) that is attached to the stowage mast (4) and through which the stowage line (10) is routed between its first end and its connection to the guide line (9), a retaining device for retaining the end of the stowage line (10) on the guide line (9), the retaining device being adapted to occupy: a free position in which the end of the stowage line (10) slides freely along the guide line (9) and a retaining position in which the end of the stowage line (10) is disposed in a loop formed by the guide line (9) as claimed in claim 7, wherein the phase of folding the traction wing (5) includes: a step of locking the stowage line (10) onto the guide line (9); a stowage step during which traction on the stowage line (10) drives traction on the guide line (9) and on the leading edge (16) of the traction wing (5).

23. The control method as claimed in claim 21 for controlling a captive wing traction system including the traction wing (5) to generate a traction force because of the effect of the wind and is deployed and folded relative to a base platform (3) that is provided with a stowage mast (4), the traction wing (5) having a leading edge (16) and a trailing edge (17), the trajectory control flying device (7) attached to the traction wing (5) by fixed suspension lines (6) and mobile suspension lines (6*b*), the trajectory control flying device (7) controls the mobile suspension lines (6*b*); a traction line (8) connecting the trajectory control flying device (7) to the base platform (3); a guide line (9) that connects the leading edge (16) of the traction wing (5) to the trajectory control flying device (7); the stowage line (10) one end of which is connected to the base platform (3) and that is connected in a sliding manner to the guide line (9) by a slider (15) fixed onto the stowage line (10) and with a pivoting sliding connection to the guide line (9); a deflector element (13) that is attached to the stowage mast (4) and through which the stowage line (10) is routed between its first end and its connection to the guide line (9) wherein the guide line (9) is connected to the leading edge (16) of the traction wing (5) by a disengageable clamping element (25) fastened to the leading edge (16) of the traction wing (5), the disengageable clamping element (25) being adapted to retain the guide line (9) by clamping it, wherein the folding phase includes: a step of disengaging the disengageable clamping element (25), the guide line (9) therefore being released; a step of traction on the stowage line (10) driving traction on the guide line (9) and on the additional line portion (24).

24. The control method as claimed in claim 21 for controlling a captive wing traction system including the traction wing (5) to generate a traction force because of the effect of the wind and is deployed and folded relative to a base platform (3) that is provided with a stowage mast (4), the traction wing (5) having a leading edge (16) and a trailing edge (17), the trajectory control flying device (7) attached to the traction wing (5) by fixed suspension lines (6) and mobile suspension lines (6*b*), the trajectory control flying device (7) controls the mobile suspension lines (6*b*); a traction line (8) connecting the trajectory control flying device (7) to the base platform (3); the guide line (9) that connects the leading edge (16) of the traction wing (5) to the trajectory control flying device (7); the stowage line (10) one end of which is connected to the base platform (3) and that is connected in a sliding manner to the guide line (9) by a slider (15) fixed onto the stowage line (10) and with a pivoting sliding connection to the guide line (9); a deflector element (13) that is attached to the stowage mast (4) and through which the stowage line (10) is routed between its first end and its connection to the guide line (9), wherein the deflector element (13) is mounted on a stowage trolley (14) sliding along the stowage mast (4) as claimed in claim 6, wherein the deployment phase and the folding phase include steps of hoisting or hauling down the traction wing (5) along the stowage mast (4), during which steps the stowage trolley (14) slides along the stowage mast (4) and the stowage line (10) is maintained under tension to hold the leading edge (16) of the traction wing (5) moored against the stowage mast (4).

25. The control method as claimed in claim 21 of a captive wing traction system including the traction wing (5) to generate a traction force because of the effect of the wind and is deployed and folded relative to a base platform (3) that is provided with a stowage mast (4), the traction wing (5) having a leading edge (16) and a trailing edge (17), the trajectory control flying device (7) attached to the traction wing (5) by fixed suspension lines (6) and mobile suspension lines (6*b*), the trajectory control flying device (7) controls the mobile suspension lines (6*b*); a traction line (8) connecting the trajectory control flying device (7) to the base platform (3); the guide line (9) that connects the leading edge (16) of the traction wing (5) to the trajectory control flying device (7); the stowage line (10) one end of which is connected to the base platform (3) and that is connected in a sliding manner to the guide line (9) by a slider (15) fixed onto the stowage line (10) and with a pivoting sliding connection to the guide line (9); a deflector element (13) that is attached to the stowage mast (4) and through which the stowage line (10) is routed between its first end and its connection to the guide line (9), wherein the slider (15) includes a shuttle (114) sliding along the guide line (9), the shuttle (114) including a guide device (63) through which the stowage line (10) pass, wherein the trajectory control flying device (7) includes a receptacle (101) to receive the slider (15), the receptacle (101) including an immobilizer (102) for the stowage line (10), wherein the method includes a flight phase during which the slider (15) is disposed on the receptacle of the trajectory control flying device (7) and the length of the stowage line (10) is controlled so as to maintain slack in the stowage line (10).

* * * * *